US012352147B2

(12) United States Patent
Payne

(10) Patent No.: US 12,352,147 B2
(45) Date of Patent: Jul. 8, 2025

(54) SYSTEMS AND METHODS FOR MULTISTAGE FRACTURING

(71) Applicant: The WellBoss Company, Inc., Calgary (CA)

(72) Inventor: Derek Slater Payne, Katy, TX (US)

(73) Assignee: The WellBoss Company, Inc., Calgary (CA)

( * ) Notice: Subject to any disclaimer, the term of this patent is extended or adjusted under 35 U.S.C. 154(b) by 0 days.

(21) Appl. No.: 18/382,632

(22) Filed: Oct. 23, 2023

(65) Prior Publication Data

US 2024/0133280 A1 Apr. 25, 2024
US 2024/0229628 A9 Jul. 11, 2024

Related U.S. Application Data

(60) Provisional application No. 63/419,025, filed on Oct. 25, 2022.

(51) Int. Cl.
*E21B 34/14* (2006.01)
*E21B 43/14* (2006.01)
*E21B 43/26* (2006.01)

(52) U.S. Cl.
CPC ..... *E21B 43/26* (2013.01); *E21B 34/14* (2013.01); *E21B 2200/06* (2020.05)

(58) Field of Classification Search
CPC ..... E21B 34/142; E21B 34/14; E21B 43/14; Y10T 403/76; Y10T 403/5766; Y10T 403/7009; Y10T 403/7026
See application file for complete search history.

(56) References Cited

U.S. PATENT DOCUMENTS

| | | | |
|---|---|---|---|
| 7,387,165 | B2 | 6/2008 | Lopez de Cardenas et al. |
| 8,672,036 | B2 | 3/2014 | Hughes et al. |
| 9,394,752 | B2 * | 7/2016 | Fleming ..... E21B 34/14 |
| 9,500,063 | B2 | 11/2016 | Greenan |
| 9,556,714 | B2 | 1/2017 | Hughes et al. |
| 9,683,419 | B2 | 6/2017 | Coon |
| 9,995,111 | B2 | 6/2018 | Hughes et al. |
| 10,001,001 | B2 | 6/2018 | Jani |
| 10,156,124 | B2 | 12/2018 | Guzman et al. |
| 2011/0240311 | A1 | 10/2011 | Robison et al. |
| 2013/0206402 | A1 | 8/2013 | Coon |
| 2013/0299200 | A1 | 11/2013 | Hughes et al. |
| 2014/0238689 | A1 | 8/2014 | Hughes et al. |
| 2015/0060076 | A1 | 3/2015 | Campbell et al. |
| 2015/0114718 | A1 | 4/2015 | Hughes et al. |
| 2015/0330185 | A1 | 11/2015 | Hughes et al. |
| 2016/0258260 | A1 | 9/2016 | Coon |
| 2016/0298404 | A1 | 10/2016 | Beckett et al. |
| 2017/0051574 | A1 | 2/2017 | Hughes et al. |
| 2017/0175488 | A1 | 6/2017 | Lisowski et al. |
| 2017/0204700 | A1 | 7/2017 | Hughes et al. |
| 2018/0038221 | A1 | 2/2018 | Hughes et al. |
| 2018/0238137 | A1 | 8/2018 | Hughes et al. |
| 2018/0238142 | A1 | 8/2018 | Hughes et al. |

* cited by examiner

*Primary Examiner* — Kenneth L Thompson
(74) *Attorney, Agent, or Firm* — Kearney, McWilliams & Davis, PLLC; John M. DeBoer

(57) ABSTRACT

A downhole system for multistage fracturing having at least a first cluster of valves. The first cluster of valves has a frac valve. The first cluster of valves also has a flex valve. A single plugging device is operable to pass through all of the valves of the first cluster of valves and leave all of them closed.

20 Claims, 16 Drawing Sheets

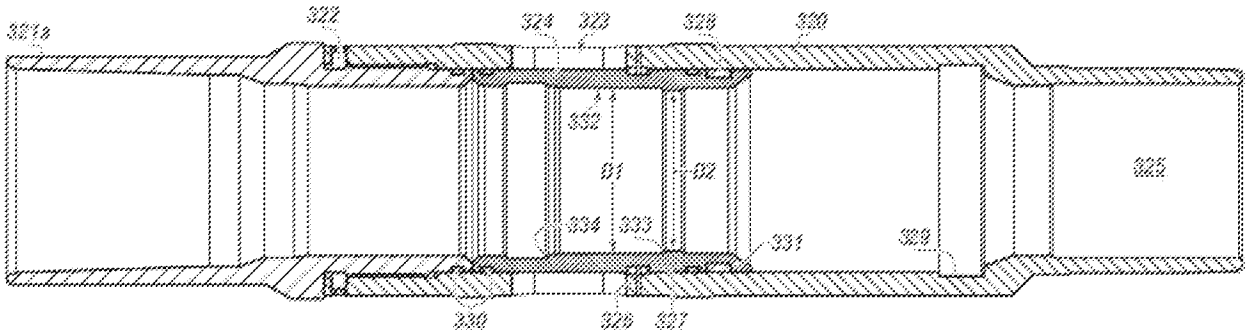
FIGURE 3A
FIGURE 3B
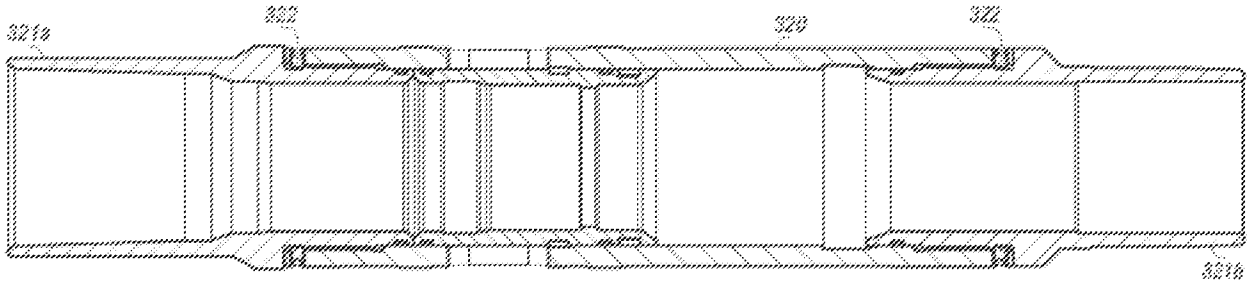

SYSTEMS AND METHODS FOR MULTISTAGE FRACTURING

BACKGROUND

Field of the Disclosure

This disclosure generally relates to downhole tools and related systems and methods used in oil and gas wellbores. More specifically, the disclosure relates to a downhole system and tool(s) that may be run into a wellbore and useable for wellbore isolation, and methods pertaining to the same. In particular embodiments, the disclosure presents a system and method for stimulating a formation in multiple stages while providing an operator with flexibility in the stages that are to be stimulated or isolated from stimulation. In still other embodiments, a single plugging device may be used to activate a plurality of frac sleeves.

Background of the Disclosure

An oil or gas well includes a wellbore extending into a subterranean formation at some depth below a surface (e.g., Earth's surface), and is usually lined with a tubular, such as casing, to add strength to the well. Many commercially viable hydrocarbon sources are found in "tight" reservoirs, which means the target hydrocarbon product may not be easily extracted. The surrounding formation (e.g., shale) to these reservoirs typically has low permeability, and it is uneconomical to produce the hydrocarbons (i.e., gas, oil, etc.) in commercial quantities from this formation without the use of drilling accompanied with fracing operations.

Fracing now has a significant presence in the industry, and is commonly understood to include the use of some type of plug set in the wellbore below or beyond the respective target zone, followed by pumping or injecting high pressure frac fluid into the zone. For economic reasons, fracing (and any associated or peripheral operation) is now ultra-competitive, and in order to stay competitive innovation is paramount. One form of a frac operation may be a 'plug and perf' type, such as described or otherwise disclosed in U.S. Pat. No. 8,955,605, incorporated by reference herein in its entirety for all purposes.

In this type of operation, the tubestring need not have any openings through its sidewalls; instead, perforations are created by so-called perforation guns which discharge shaped charges through the tubestring and, if present, adjacent cement. The zone near the perf is then hydraulically fractured, followed by the setting of a new plug, re-perf, etc. That process is repeated until all zones in the well are fractured.

The plug and perf method is widely practiced, but it has a primary drawback of being time consuming. Other problems include: plug defects (such as slippage, presets, hang ups, and drillout issues), perf erosion, wireline and drillout crew resource required, and the plug run times associated with wireline, especially during single well operations.

Multistage fracturing is another form of frac operation that also enjoys popularity. In this type of frac operation, multi-stage wells require the stimulation and production of one or more zones of a formation. Conventionally, a liner, casing, or other type of tubestring is downhole, in which the tubestring includes one or more downhole frac valves (and may further include, but not be limited to, ported sleeves or collars) at spaced intervals along the wellbore.

Such frac valves typically include a cylindrical housing that may be threaded into and forms a part of the tubestring.

The housing defines a flowbore through which fluids may flow. Ports are provided in the housing (e.g., sidewall) that may be opened by actuating a sliding sleeve. Once opened, fluids are able to flow through the ports and fracture the formation in the vicinity of the valve, and vice versa.

The location of the frac valves is commonly set to align with the formation zones to be stimulated or produced. The valves must be manipulated in order to be opened or closed as required. In the case of multistage fracking, multiple frac valves are used in a sequential order to frac sections of the formation, typically starting at a toe end of the wellbore and moving progressively towards a heel end of the wellbore. It is crucial that the frac valves be triggered to open in the desired order and that they do not open earlier than desired.

By way of example, FIG. 1 shows a conventional multistage production system using a plurality of frac valves 102. The frac valves 102 may be incorporated into a tubular 104 disposed in a typical wellbore 106 formed in a subterranean formation 110.

The wellbore 106 may be serviced by a derrick or rig 103 and various other surface equipment (not shown). The wellbore 106 may be provided with a casing string 105, which may be part of tubular 104. The tubular 104 may include or be coupled with the casing string 105 via a hanger 101. It will be noted that part of the wellbore 106, and part of the wellbore may be generally horizontal. The tubular 104 may be cemented in place via cement 107.

A typical frac operation will generally proceed from the lowermost zone in the wellbore (sometimes the 'toe') to the uppermost zone (sometimes the 'heel'). FIG. 1 shows fractures 109 have been established in the vicinity of the frac valves 102 in zones near the toe 111. Additional uphole zones in the wellbore 106 may be fracked in succession until all stages of the frac operation have been completed, and fractures in all desired zones have been established.

In some instances (not viewable here), the tubular 104 is arranged with valves having seats of increasing inside diameter progressing from toe to heel. The valves are manipulated by pumping multiple plug devices, such as balls, plugs or darts, each having sequentially increasing outside diameters, down the tubestring. The first plug, having the smallest outside diameter passes through all frac valves until it seats on the first (or furthermost) valve seat, having the smallest inside diameter.

When a plug lands on a respective seat, fluid pressure uphole of the plug urges the plug downhole, which causes it to induce analogous movement of a sleeve of the valve downhole, which exposes the ports of the frac valve. In this arrangement, each valve must be uniquely built with a specific seat size and must be arranged on the tubestring in a specific order. Additionally, a stock of plug devices of all sizes of diameter must always be maintained to be able to manipulate all of the unique valve seats.

In other cases, opening of the frac valve is achieved by running a bottom hole assembly, also known as an intervention tool, down on a workstring through the tubestring, locating in the frac valves to be manipulated and manipulating the valve by any number of means including use of mechanical force on the intervention tool, or by hydraulic pressure. However, the use of an intervention tool is not always desirable; the workstring on which the intervention tool is run presents a flow restriction within the tubestring and prevents the full-bore fluid flow required within the tubestring to achieve the needed stimulation pressure.

Despite popularity, multistage fracturing with frac valves has its own share of problems. Sleeve design problems include: limited number of stages per well, the need for coiled tubing in the hole during operations, and the need for drilling out seats post operations. Many conventional systems utilize a ball drop process that requires a high amount of precision not always achievable. Modern designs that attempt to solve these issues are overly complex, and require a wide array of varied tools (which corresponds to high manufacture costs).

A conventional counting dart used for multistage fracturing might have an axial or longitudinal counting mechanism—every time the dart touches a sleeve, some kind of mechanical increment occurs so that the sleeve is counted. The sleeve count is important so that the dart knows which sleeve to eventually stop at. However, axial forces are extremely problematic, as the dart might be slammed into the sleeve via pumping speeds. External counting mechanisms are also prone to inadvertent bumping and resultant errors in counting (and thus blocking the wrong sleeve). Even more problematic is that a formation with a high number of stages requires a dart length of many feet (e.g., in excess of 5 feet), which is impracticable for small wellbore confines, and cost prohibitive for situations where (expensive) dissolving material might be needed.

A need exists for simple but robust system in which multiple frac valves (one or more of which may be identical) may be run downhole, and may be opened in any sequence by a single device.

There is a need for a frac valve system that does not require the use of an intervention tool or of unique frac valves and dedicated balls or plugs. There is a need for a system that may be operable to open one or more frac valves in any order desired, and may provide for repeated opening and closing one or more frac valves within a tubestring for varying purposes.

There is a need for a plugging device that increases reliability and efficiency, and does not need significant extensions in axial length in order to accommodate a high number of stages. The ability to save cost on materials and/or operational time (and those saving operational costs) leads to considerable competition in the marketplace. Achieving any ability to save time, or ultimately cost, leads to an immediate competitive advantage.

Accordingly, there are needs in the art for novel systems and methods for isolating wellbores in a fast, viable, and economical fashion.

SUMMARY

Embodiments of the disclosure pertain to a downhole system for stimulating one or more stages of a downhole wellbore. The system may include one or more frac valves arranged on or in association with a tubular; any of such frac valves presenting an inside profile comparable or identical to another, and any of which may be openable for providing fluid communication between internal and external of the tubular. There may be an at least one dart or plugging device deployable into the tubular, and being adjustable to pass through one or more frac valves without opening one or more frac valves, and yet may be able to engage and open one or more other frac valves.

Other embodiments of the disclosure pertain to a system for stimulating a subterranean formation that may include a wellbore formed within the subterranean formation; and a tubular disposed within the wellbore.

Embodiments of the disclosure pertain to a downhole system for multistage fracturing a subterranean formation that may include one or more of: a first cluster of valves; a second cluster of valves downhole of the first cluster; and/or a third cluster of valves downhole from the second cluster.

There may be a plugging device having a plug body. The plug body may have a distal end, a proximate end, and an outer surface. There may be a plurality of grooves disposed on the outer surface. The plugging device may have a shiftable sleeve movingly disposed on or otherwise engaged with the outer surface. The shiftable sleeve may have an upper sleeve end and a lower sleeve end, the shiftable sleeve configured to traverse the plurality of grooves.

In assembly, the shiftable sleeve may be set in an initial position corresponding to the desired target frac valve. The shiftable sleeve may be in the initial position prior to entering the first cluster of valves. During engagement with a frac valve of the first cluster, the shiftable sleeve may be incremented (such as one groove) along the plurality of grooves. The shiftable sleeve may be moved to a first armed position by one of the second cluster of valves. The plugging device may not open any valves of the first and second cluster of valves, but opens every valve of another (such as the third) cluster of valves.

Any of the first cluster of valves, the second cluster of valves, and the third cluster of valves may include a flex valve. Any flex valve may include a respective flex sleeve configured with rigid portion and a flexible portion. The flexible portion may include a plurality of fingers. In aspects, the shiftable sleeve may not be able to engage the plurality of fingers unless it is in the first armed position or a final armed position.

Any of the first cluster of valves, the second cluster of valves, and the third cluster of valves each may include a frac valve comprising a respective solid sleeve configured with an inner sleeve shoulder.

The plugging device may engage, but need not open, any of the frac valves of the first and/or second cluster of valves. The plugging device may engage and open the frac valve of the third cluster of valves.

The plugging device may include any of: a lower sleeve engaged with the distal end; an upper sleeve engaged with the proximate end; and/or a removable plug sealingly disposed within the upper sleeve.

Any groove of the plurality of grooves of embodiments herein may be characterized as having a respective trough and crest. Or comparably, may be a plurality of splines or a splined surface.

The plugging device may include an upper fin, which may be engaged with the upper sleeve. The upper fin may be configured with a catch shoulder configured to hold the removable plug in sealing engagement with the upper sleeve.

Other embodiments pertain to a plugging device having a plug body. The plug body may have a distal end, a proximate end, and an outer surface. There may be a plurality of grooves or splines disposed on the outer surface. The plugging device may have a shiftable sleeve movingly disposed on the outer surface.

Still other embodiments pertain to a frac valve—plugging device assembly. The assembly may include the plugging device engaged with the frac valve.

Other embodiments pertain to a downhole system for multistage fracturing a subterranean formation. The system may include one or more of: a first cluster of valves; a second cluster of valves downhole of the first cluster; and/or a third cluster of valves downhole from the second cluster.

The system may have a plugging device, which may have a plug body having a distal end, a proximate end, and an outer surface. There may be one or more track grooves disposed on the outer surface. The device may have a shiftable index sleeve (or just 'shiftable sleeve') movingly disposed on the outer surface. The shiftable sleeve may have one or more sleeve member receptacles, each with a respective movable member disposed therein.

The shiftable sleeve may be set in an initial position before entering the first cluster of valves. After leaving and moving on from the first cluster of valves the shiftable sleeve may be incremented (such as from the distal end toward the proximate end), and at the same time a sleeve tab may be incremented circumferentially from one groove of the plurality of track grooves to an adjacent track groove.

In aspects, the shiftable sleeve may be moved to a first armed position by one of the second cluster of valves. The plugging device need not open any valves of the first and second cluster of valves, but may be armed and configured to open every valve of the third cluster of valves.

Any valve of the first cluster of valves, the second cluster of valves, and/or the third cluster of valves may be a flex valve comprising a flex sleeve configured with rigid portion and a flexible portion. The flexible portion may have a plurality of fingers. The shiftable sleeve may be configured in a manner that prevents engagement of the plurality of fingers unless the sleeve is in the first armed position or a final armed position.

The plugging device further may have a bearing plate having a bearing plate outer diameter and an expandable load ring having a load ring outer diameter. The final armed position may have the expandable load ring having the load ring outer diameter larger than the bearing plate outer diameter.

In aspects, any or every of the first cluster of valves, the second cluster of valves, and/or the third cluster of valves may have a respective frac valve configured with a solid sleeve with an inner sleeve shoulder.

The plugging device may engage, but need not open, each of the frac valves of the first and second cluster of valves. The plugging device may engage, and may open, the frac valve of the third cluster of valves. The shiftable sleeve may be unable to open the frac valve of the third cluster of valves unless the shiftable sleeve is in a final armed position.

Any or all of the plurality of track grooves may be linear longitudinally along a long axis of the plugging device. A midpoint of one of the plurality of track grooves may be offset radially in a degree range of degrees from a respective midpoint of a directly adjacent track groove. The number of the plurality of track grooves may be in a track groove count range of at least 10 to no more than 100.

Still other embodiments herein may pertain to a plugging device for use in a wellbore that may have a main body, one or more track grooves, and a shiftable sleeve. The main body may have a distal end, a proximate end, an outer surface, and an inner bore. There may be a plurality of track grooves disposed on the outer surface. While not limited in nature, the plurality of track grooves may be linear longitudinal akin to a splined surface. There may be a shiftable sleeve movingly disposed on the outer surface. The shiftable sleeve may have a plurality of sleeve member receptacles. Any receptacle may have a respective movable member disposed therein. The movable member may be any desired shape, such as spherical or non-spherical.

The plurality of sleeve member receptacles may be disposed in a first helical and a second helical around the main body. There may be a first respective movable member of the first helical has a midpoint lying in a first plane, and wherein a first (adjacent) respective movable member of the second helical has a respective midpoint also lying in the first plane. There maybe a movable member of any helical with a proximate adjacent member lying in the same plan thereof. These members may be the last members of any helical to be moved.

These and other embodiments, features and advantages will be apparent in the following detailed description and drawings.

BRIEF DESCRIPTION OF THE DRAWINGS

A full understanding of embodiments disclosed herein is obtained from the detailed description of the disclosure presented herein below, and the accompanying drawings, which are given by way of illustration only and are not intended to be limitative of the present embodiments, and wherein:

FIG. 3A shows a longitudinal side cross-sectional view of a solid sleeve frac valve, according to embodiments of the disclosure;

FIG. 3B shows a longitudinal side cross-sectional view of a solid sleeve frac valve having a lower end fitting according to embodiments of the disclosure;

DETAILED DESCRIPTION

Figure 1:
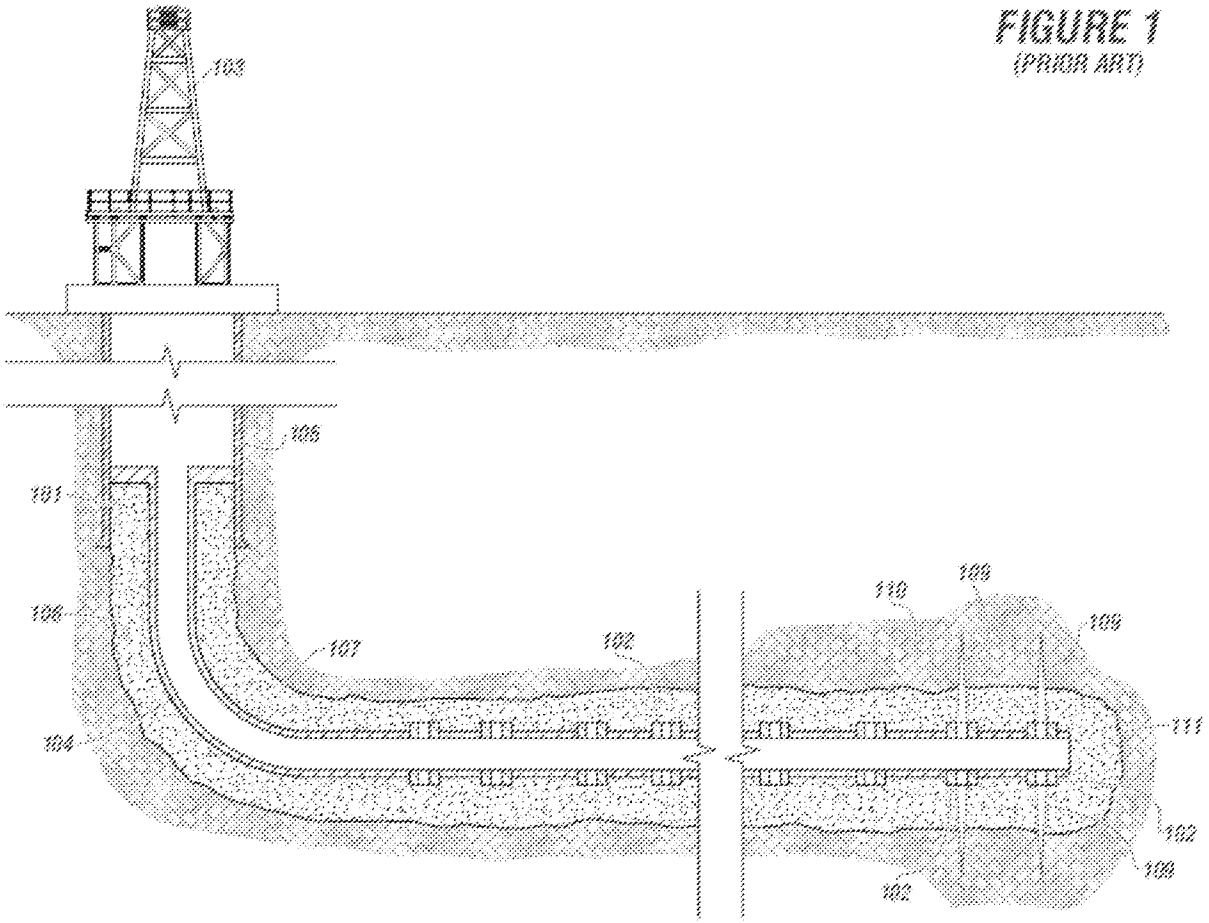
FIGURE 1 (PRIOR ART)
FIG. 1 shows a side view of a process diagram of a conventional multistage fracture system.

Herein disclosed are novel apparatuses, assemblies, systems, and methods that pertain to and are usable for wellbore operations, and aspects (including components) related thereto, the details of which are described herein.

This may include use of a series of movable members (such as ball bearings) in a shiftable sleeve in order to count stages in a rotational direction (as opposed to a linear direction). When passing under a full diameter restriction (such as a sleeve), the movable members may be urged inward one set at a time, which push against angled grooves in the device body to cause a rotational motion of the shiftable sleeve. A single count may occur when a tab or finger(s) of the sleeve moves from one groove in the body to the next. Each set of movable members that is pushed inward only contributes to a fraction of one count. Because of this, a complete ID restriction is required to cause the device to fully count. If only one side of the device is grazed and only a few of the members are moved inward, the device will not increment or count. A majority of the movable members need to be depressed to get the device to fully count.

Embodiments of the present disclosure are described in detail in a non-limiting manner with reference to the accompanying Figures. In the following discussion and in the claims, the terms "including" and "comprising" are used in an open-ended fashion, such as to mean, for example, "including, but not limited to . . . ". While the disclosure may be described with reference to relevant apparatuses, systems, and methods, it should be understood that the disclosure is not limited to the specific embodiments shown or described. Rather, one skilled in the art will appreciate that a variety of configurations may be implemented in accordance with embodiments herein.

Although not necessary, like elements in the various figures may be denoted by like reference numerals for consistency and ease of understanding. Numerous specific details are set forth in order to provide a more thorough understanding of the disclosure; however, it will be apparent to one of ordinary skill in the art that the embodiments disclosed herein may be practiced without these specific details. In other instances, well-known features have not been described in detail to avoid unnecessarily complicating the description. Directional terms, such as "above," "below," "upper," "lower," "front," "back," "right", "left", "down", etc., are used for convenience and to refer to general direction and/or orientation, and are only intended for illustrative purposes only, and not to limit the disclosure, unless expressly indicated otherwise.

Connection(s), couplings, or other forms of contact between parts, components, and so forth may include conventional items, such as lubricant, additional sealing materials, such as a gasket between flanges, PTFE between threads, and the like. The make and manufacture of any particular component, subcomponent, etc., may be as would be apparent to one of skill in the art, such as molding, forming, press extrusion, machining, or additive manufacturing. Embodiments of the disclosure provide for one or more components that may be new, used, and/or retrofitted.

Various equipment may be in fluid communication directly or indirectly with other equipment. Fluid communication may occur via one or more transfer lines and respective connectors, couplings, valving, and so forth. Fluid movers, such as pumps, may be utilized as would be apparent to one of skill in the art.

Numerical ranges in this disclosure may be approximate, and thus may include values outside of the range unless otherwise indicated. Numerical ranges include all values from and including the expressed lower and the upper values, in increments of smaller units. As an example, if a compositional, physical or other property, such as, for example, molecular weight, viscosity, temperature, pressure, distance, melt index, etc., is from 100 to 1,000, it is intended that all individual values, such as 100, 101, 102, etc., and sub ranges, such as 100 to 144, 155 to 170, 197 to 200, etc., are expressly enumerated. It is intended that decimals or fractions thereof be included. For ranges containing values which are less than one or containing fractional numbers greater than one (e.g., 1.1, 1.5, etc.), smaller units may be considered to be 0.0001, 0.001, 0.01, 0.1, etc. as appropriate. These are only examples of what is specifically intended, and all possible combinations of numerical values between the lowest value and the highest value enumerated, are to be considered to be expressly stated in this disclosure. Others may be implied or inferred.

Embodiments herein may be described at the macro level, especially from an ornamental or visual appearance. Thus, a dimension, such as length, may be described as having a certain numerical unit, albeit with or without attribution of a particular significant figure. One of skill in the art would appreciate that the dimension of "2 centimeters" may not be exactly 2 centimeters, and that at the micro-level may deviate. Similarly, reference to a "uniform" dimension, such as thickness, need not refer to completely, exactly uniform. Thus, a uniform or equal thickness of "1 millimeter" may have discernable variation at the micro-level within a certain tolerance (e.g., 0.001 millimeter) related to imprecision in measuring and fabrication.

Terms

The term "connected" as used herein may refer to a connection between a respective component (or subcomponent) and another component (or another subcomponent), which can be fixed, movable, direct, indirect, and analogous to engaged, coupled, disposed, etc., and can be by screw, nut/bolt, weld, and so forth. Any use of any form of the terms "connect", "engage", "couple", "attach", "mount", etc. or any other term describing an interaction between elements is not meant to limit the interaction to direct interaction between the elements and may also include indirect interaction between the elements described.

The term "fluid" as used herein may refer to a liquid, gas, slurry, multi-phase, etc. and is not limited to any particular type of fluid such as hydrocarbons.

The term "fluid connection", "fluid communication," "fluidly communicable," and the like, as used herein may refer to two or more components, systems, etc. being coupled whereby fluid from one may flow or otherwise be transferrable to the other. The coupling may be direct or indirect. For example, valves, flow meters, pumps, mixing tanks, holding tanks, tubulars, separation systems, and the like may be disposed between two or more components that are in fluid communication.

The term "pipe", "conduit", "line", "tubular", or the like as used herein may refer to any fluid transmission means, and may be tubular in nature.

The term "tubestring" or the like as used herein may refer to a tubular (or other shape) that may be run into a wellbore. The tubestring may be casing, a liner, production tubing, combinations, and so forth. A tubestring may be multiple pipes (and the like) coupled together.

The term "workstring" as used herein may refer to a tubular (or other shape) that is operable to provide some kind of action, such as drilling, running a tool, or any other kind of downhole action, and combinations thereof.

The term "frac operation" as used herein may refer to fractionation of a downhole well that has already been drilled. 'Frac operation' can also be referred to and interchangeable with the terms fractionation, hydrofracturing, hydrofracking, fracking, fracing, frack, frac, etc. A frac operation can be land or water based.

The term "mounted" as used herein may refer to a connection between a respective component (or subcomponent) and another component (or another subcomponent), which can be fixed, movable, direct, indirect, and analogous to engaged, coupled, disposed, etc., and can be by screw, nut/bolt, weld, and so forth.

The term "machined" can refer to a computer numerical control (CNC) process whereby a robot or machinist runs computer-operated equipment to create machine parts, tools and the like.

The term "parallel" as used herein may refer to any surface or shape that may have a reference plane lying in the same direction as that of another. It should be understood that parallel need not refer to exact mathematical precision, but instead be contemplated as visual appearance to the naked eye.

The term "helical" as used herein may refer to taking a coil or spring wound shape. The helical may have its own beginning and its own end (as compared to a ring, where there is no end).

The term "shiftable sleeve" as used herein may refer to a sleeve that is movable from a first position to another or second position. The first position may be an initial (such as resting or run-in) position. The second position may be an intermediate position, or may be a final or armed position.

The term "cluster of valves" as used herein may refer to a grouping of at least one flex sleeve valve in proximity or association with a solid sleeve valve.

The term "stage" as used herein may refer to consideration of at least one fracturing job associated with an area of a zone or formation proximate a (armed) plugging device landed or seated in a solid sleeve valve.

The term "zone" as used herein may refer to an area of interest in a subterranean formation.

Figure 2A:
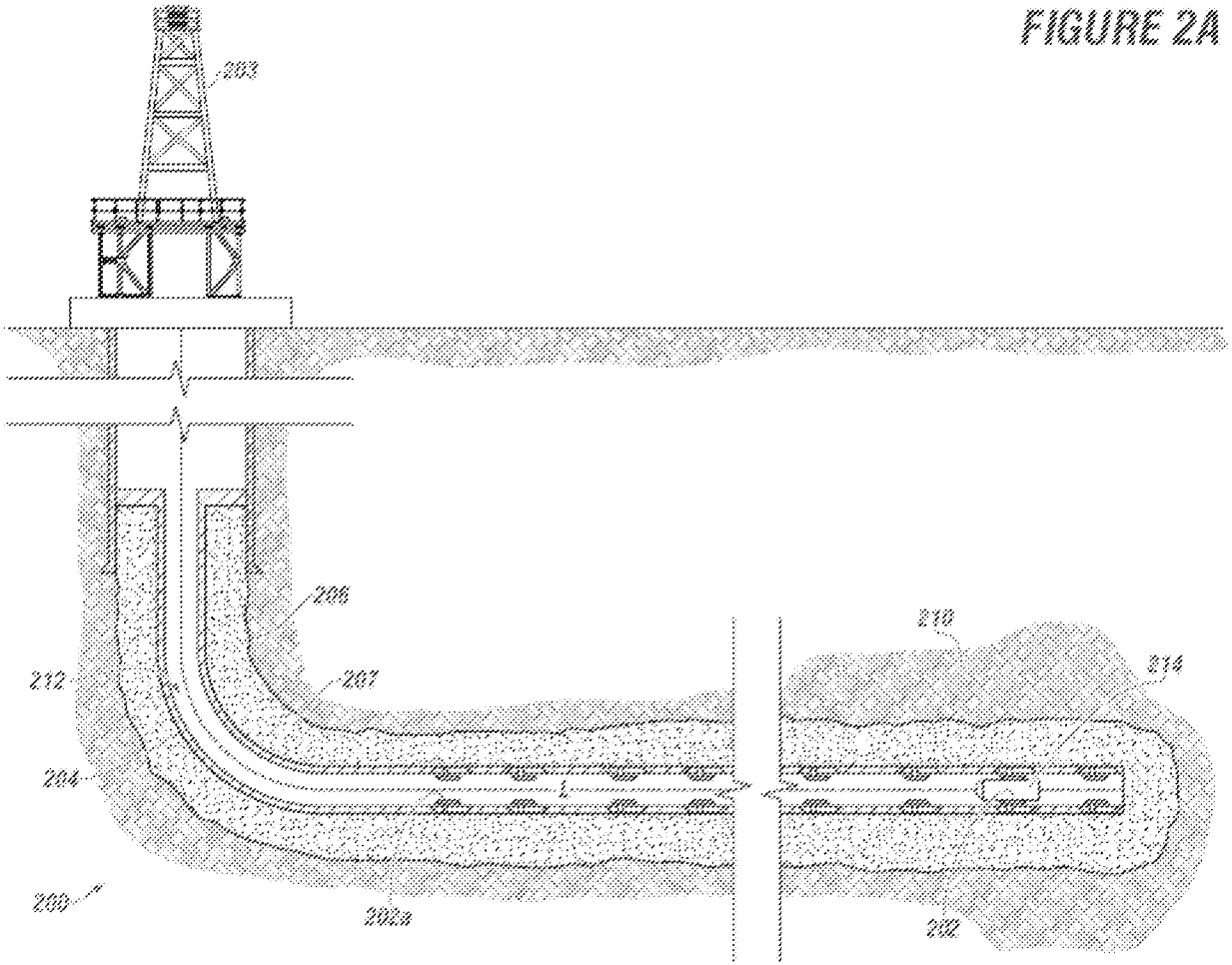
FIG. 2A shows a side view of a multistage fracture system with a cemented tubular having one or more valve clusters according to embodiments of the disclosure.
Figure 2B:
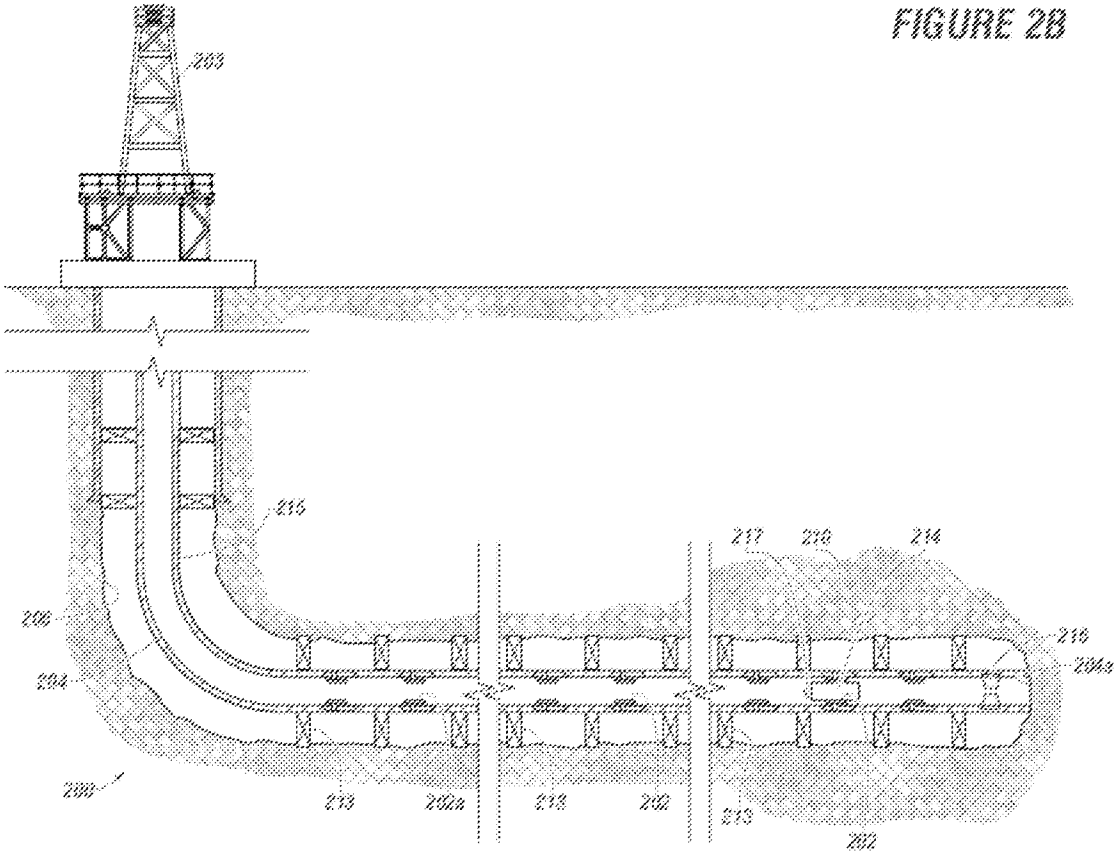
FIG. 2B shows a side view of a multistage fracture system with a packer-supported tubular having one or more valve clusters according to embodiments of the disclosure.

Referring now to FIGS. 2A and 2B together, a side process view of multistage completion system having a cemented tubular, and a multistage completion system having a packer supported tubular, each having a plurality of frac valves, in accordance with embodiments disclosed herein, are shown.

FIGS. 2A and 2B may be contemplated as system 200 being generally similar, with the exception that FIG. 2A illustrates use of cement 207 for the support of a tubular 204, whereas FIG. 2B illustrates use of one or more packers 213. As such, reference may be made to FIGS. 2A and 2B interchangeably in a general sense, unless described or referenced otherwise. That said, embodiments herein are not meant to be limited, and may include the scenario where the wellbore 206 may be both cemented and having packers 213. The packers 213 may be open hole packers.

The wellbore 206 may be an open hole, a cased hole, or a hybrid thereof, with a portion cased and a portion open. The wellbore 206 may be vertical, horizontal, deviated or of any orientation. Embodiments herein may pertain to offshore or onshore operations. The wellbore 206 may be serviced by a derrick (or other suitable rig-type structure) 203 and various other surface equipment (pumps, production string, drill string, etc.—not shown).

Components of system 200 may be operable separately or together to provide fluid communication between an inside 212 of the tubular 204 and outside thereof, such as to an annulus 215 or to a surrounding surface 210. The surrounding surface 210 may be (at least a portion of) a subterranean formation.

One or more frac valves 202 may be installed at any point along a length L of the tubular 204. Frac valves 202 may be installed onto or otherwise with the tubular 204, and along the length L at strategic of predetermined points. As the tubular 204 is disposed within the wellbore 206, sections of the tubular 204 may be coupled together, such as when stands of pipe have box and pin ends that are engaged. Valves 202 may be installed between joints of the tubular 204. A lower toe valve 216 may be placed near the lower, or toe end 204*a* of the tubular 204.

A downhole tool such as a plugging device 214 may be used to shift a sleeve of the frac valve 202 from a first position to a second position. The first position may have ports of the valve closed by the sleeve, and a second position may have ports of the valve opened as the sleeve is shifted. A ball 217 may be used with or be part of the plugging device 214. In embodiments the plugging device 214 may be a dart configured with a ball seat for the ball 217 to seat thereon.

Embodiments herein may entail use of various main components. The aforementioned plugging device 214 and frac valve 202. Alas, various types and configurations of the plugging device 214 and frac valve 202 may be utilized. For example, there may be a first configuration of a frac valve 202 having a solid sleeve. There may be a second configuration of a frac valve 202*a* having a flex sleeve (or collet sleeve). To provide the reader with ease in distinguishing, the first configuration may simply be referred to as frac valve, whereas the second configuration may be referred to as a 'flex valve' (or 'flex frac valve', 'flex sleeve valve, and the like).

The plugging device 214 may be configured to engage either type or both of the frac valve 202 and the flex valve 202*a*. A plurality of valves 202, 202*a* may be referred to as a 'cluster' of valves (or 'valve cluster'). The plugging device 214 may be configured to engage and open a frac valve 202, and also engage and open a flex valve 202*a*. A valve cluster may include at least one frac valve and one flex valve. There may be a plurality of valve clusters. The number of clusters may coincide to the number of stages for completion. For example, if desired to fracture one stage, one cluster of valves may be utilized.

In embodiments, there may be a first frac valve cluster having a first frac valve and first flex valve, and a second valve cluster having a second frac valve and a second flex valve. The plugging device may be configured to engage, but not open the first frac valve, pass through the first flex valve, and engage and open the second frac valve. Other valves 202, 202*a* may be therebetween.

The plurality of valves 202, 202*a* may be installed on, and/or as part of, the tubular 204, and spaced apart as desired or otherwise mentioned herein. The plugging device 214 may be deployed into the tubular 204, and pumped down therein towards the valves 202, 202*a*. Although one or more plugging devices 214 may be utilized, it is within the scope of the disclosure that embodiments herein need only utilize a single plugging device 214 to open multiple valves. The number of plugging devices 214 desired or used may relate to the number of stages of the formation 210 to be stimulated. For example, a first plugging device may be used to open all the valves 202, 202*a* of a first or lower cluster, while a second plugging device may be used to open all the valves 202, 202*a* of a second or upper cluster.

The valves of any cluster need not be identical. With that said, valves 202, 202*a* may have identical (within high tolerance) diameter seat sizes. The frac valves 202 do not need to be installed in any particular order. However, it is within the scope of the disclosure that two or more valves 202, 202*a* may have similar or identical: (within reasonable machine tolerance) end connections (fittings), outside diameter (O.D.), and inside profile. The frac valve 202 may have a valve sleeve (or seat) of the same profile as any other frac valve 202. The sleeve may be shiftable sleeve to expose ports in order to facilitate or allow for fluid communication between an inside of the valve 202 (or tubular 204) and formation 210 surrounding it.

The opening pressure required to shift the sleeve may be adjustable via adjustment or configuration of one or more retainer members. The retainer member may be configured to hold the sleeve in an initial or first closed position. In aspects, any valve 202, 202*a* may be configured with the same opening pressure or force requirement to shift a respective sleeve.

Referring now to FIGS. 3A and 3B together, a longitudinal side cross-sectional view a frac valve and a longitudinal side cross-sectional view a frac valve having a lower end fitting, in accordance with embodiments disclosed herein, are shown.

The frac valve 302 may have a main valve body 320. The frac valve 302 may include one or more end fittings 321*a* and 321*b* (such as shown on 3B), which may be on either or each end of the main body 320. As such, the end fittings 321*a*, 321*b* may be integral with the main body 320, or be coupled therewith, such as threadingly, via the use of one or more respective securing members 322 (e.g., pins, set screws, or the like), or combinations thereof. The use of separate end fittings 321*a*, 321*b* may allow for ease of manufacture of the main body 320, and at the same time allow for the frac valve 302 to be configured for coupling with varied joints. The end fittings 321*a*, 321*b* may be configured for coupling respective ends (e.g., one for box end, other for pin end, etc.) of the tubular (204) joints.

The main body 320 may have an inner bore 325, which may be at least partially open through an entire body length of the valve 302. There may be a valve sleeve (or seat) 324 disposed therein. The valve sleeve 324 may be shiftable. The valve sleeve 324 may be shiftable from a first position to a second position. The first position of the sleeve 324 may be where the ports 323 are closed (e.g., blocked) by the sleeve 324. The second position of the sleeve 324 may be any position thereof whereby the sleeve 324 no longer blocks, at least partially, the ports 323. The second position may include or be related to the breakage at least one retainer member 326. The second position of the sleeve 324 may be a fully open position, which may coincide with the ports 323 being completely unblocked. The second position may include a bias member 328 expanded into a receptacle 329.

The first position may correspond to a lack of communication between the bore 325 and the external side of the valve 302. The second position may correspond to the ability to have fluid communication between the bore 325 and the external side of the valve 302.

The valve sleeve 324 may be held temporarily in place in the first position via one or more retainer members 326. The main body 320 may have a retainer member receptable 327 for the respective member 326 to engage therewith. The retainer member 326 may be a shear screw, pin, etc. As such, the amount of force needed to move the valve sleeve 324 may be predetermined. Once the member(s) 326 breaks, the valve sleeve 324 may freely move. The valve sleeve 324 may also be sealingly engaged with the main body 320 via one or more seals, o-rings, etc. 330.

The valve sleeve 324 may sealingly and slidingly move downward until a sleeve groove 331 may be laterally proximate a main body receptacle 329. The sleeve groove 331 may be circumferential around the outside surface of the sleeve 324. In a comparable manner, the main body receptacle 329 may be circumferential around the inside surface of the main body 320. A biased member, such as a snap ring, 328 may be disposed within the sleeve groove 331. As one of skill would appreciate, as the groove 331 and the receptacle 329 align, the bias member 328 may expand outward, which may then provide an added shoulder or stop for the sleeve 324. The expansion of the bias member 328 into the receptacle 329 may help keep the valve sleeve 324 in place without any further sliding upward or downward.

The sleeve 324 may have an inner sleeve surface 332, which may be defined by a continuous sleeve inner diameter D1. The inner sleeve surface 332 may have an annular sleeve shoulder (or rib, protrusion, catch, seat, etc.) 333, which may be defined with an inner(most) shoulder having a diameter D2. In embodiments, D1 may be greater than D2. The sleeve shoulder 333 may be configured for part of a plugging device (e.g., 214) to engage therewith. In the event the sleeve 324 is shifted, the plugging device may be configured to disengage with the shoulder 333.

An upper end of the inner sleeve surface 332 may form a sleeve seal shoulder 334. The plugging device may also be configured to engage the sleeve seal shoulder 334.

Figure 4:
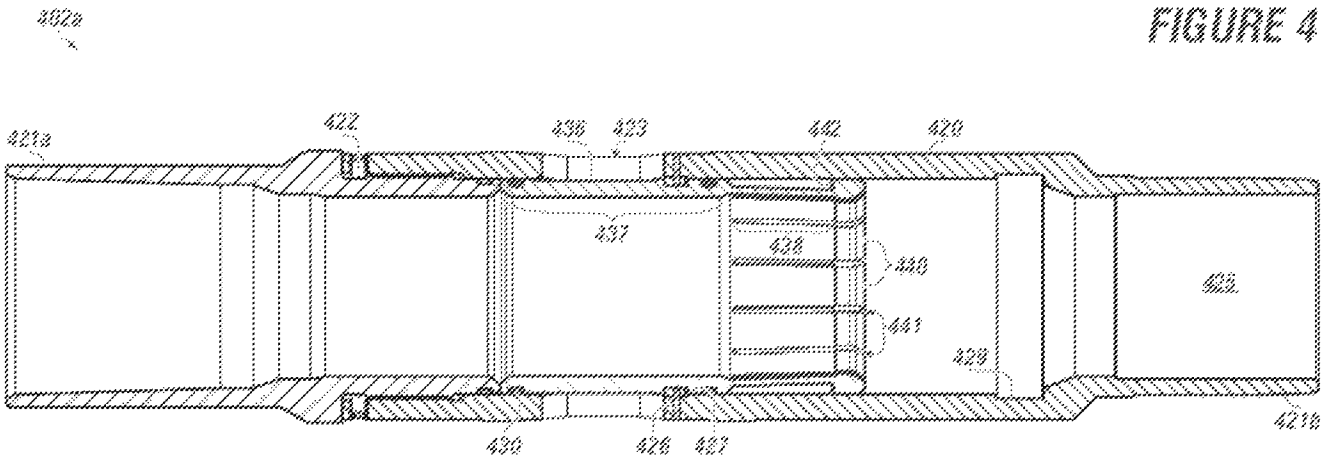
FIG. 4 shows a longitudinal side cross-sectional view of a flex sleeve frac valve, according to embodiments of the disclosure.

Referring now to FIG. 4, a longitudinal side cross-sectional view of a flex valve, in accordance with embodiments disclosed herein, are shown.

By way of comparing FIG. 3 and FIG. 4, one of ordinary skill would appreciate the flex valve 402*a* may be generally similar to the frac valve 302, and in some respect may even be identical. This may useful to help offset problems or expense attributable to machining many varied parts, versus just a few. Still, there may be differences, such as, for example, the presence of a flex sleeve 436. Other differences are within the scope of the disclosure.

The flex valve 402*a* may be run, positioned, and opened as described herein and in other embodiments (such as in system 200, and so forth), and as otherwise understood to one of skill in the art. The flex valve 402*a* may be comparable or identical in aspects, function, operation, components, etc. as that of other valve embodiments disclosed herein. Similarities may not be discussed for the sake of brevity. The flex valve 402*a* may be part of a valve-plugging device assembly.

For the sake of ease to the reader, components of the flex valve 402*a* may be described in a manner comparable to that of the frac valve 302. As such, the flex valve 402*a* may have a main flex valve body 420. The flex valve 402 may include one or more end fittings 421*a* (or comparable to 321*b* on FIG. 3B), which may be on either or each end of the main flex body 420*a*. As such, the end fittings may be integral with the main body 420, or be coupled therewith, such as threadingly, or via the use of one or more respective securing members 422 (e.g., pins, set screws, or the like). The end fittings 421*a*, etc. may be configured for coupling respective ends (e.g., one for box end, other for pin end, etc.) of the tubular (204) joints.

The main body 420 may have an inner flex bore 425, which may be at least partially open through an entire body length of the valve 402*a*. There may be a flex valve sleeve (or seat) 424 disposed therein. The flex valve sleeve 424 may have a rigid portion 437 and a flex portion 438, the flex portion 438 essentially a plurality of fingers 440 (with respective slots 441 therebetween) that may be flexible. As shown in FIG. 4, in an assembled (run-in, first, unactivated, etc.) configuration, the fingers 440 may be in a flexed inward position.

The flex valve sleeve 424 may be shiftable. The valve sleeve 424 may be shiftable from a first position shown in FIG. 4 to a second position (see FIG. 6T). The first position of the sleeve 424 may be where the flex ports 423 are closed (e.g., blocked) by the sleeve 424. The second position of the sleeve 424 may be any position thereof whereby the sleeve 424 no longer blocks, at least partially, the ports 423. The second position of the sleeve 424 may be a fully open position, which may coincide with the ports 423 being completely unblocked. The second position may include ends 442 of fingers 440 flexed radially outward into a flex body receptacle 429. The flex body receptacle 429 may be an inner annular grove within the body 420.

The first position may correspond to a lack of communication between the bore 425 and the external side of the flex valve 402*a*. The second position may correspond to the ability to have fluid communication between the bore 425 and the external side of the flex valve 402*a*.

The flex valve sleeve 424 may be held temporarily in place in the first position via one or more retainer members 426. The main body 420 may have a retainer member receptable 427 for the respective member 426 to engage therewith. The retainer member 426 may be a shear screw, pin, etc. As such, the amount of force needed to move the flex valve sleeve 424 may be predetermined. Once the member(s) 426 breaks, the flex valve sleeve 424 may freely move. The flex valve sleeve 424 may also be sealingly engaged with the main body 420 via one or more seals, o-rings, etc. 430.

As one of skill would appreciate, as end(s) 442 of respective fingers 440 and the receptacle 429 align, the ends 442 may expand outward. The expansion of the ends 442 into the receptacle 429 may help keep the flex valve sleeve 424 in place without any further sliding upward or downward (and thus the valve 402*a* may be opened, and kept open).

The sleeve 424 may have an inner sleeve surface, which may be defined by a continuous sleeve inner diameter. The inner sleeve surface may be configured for part of a plugging device (e.g., 214) to engage therewith. In embodiments, an inner edge of finger ends 442 may be configured for part of the plugging device to engage therewith. In the event the sleeve 424 is shifted, the plugging device may be configured to disengage therefrom.

Figure 5A:
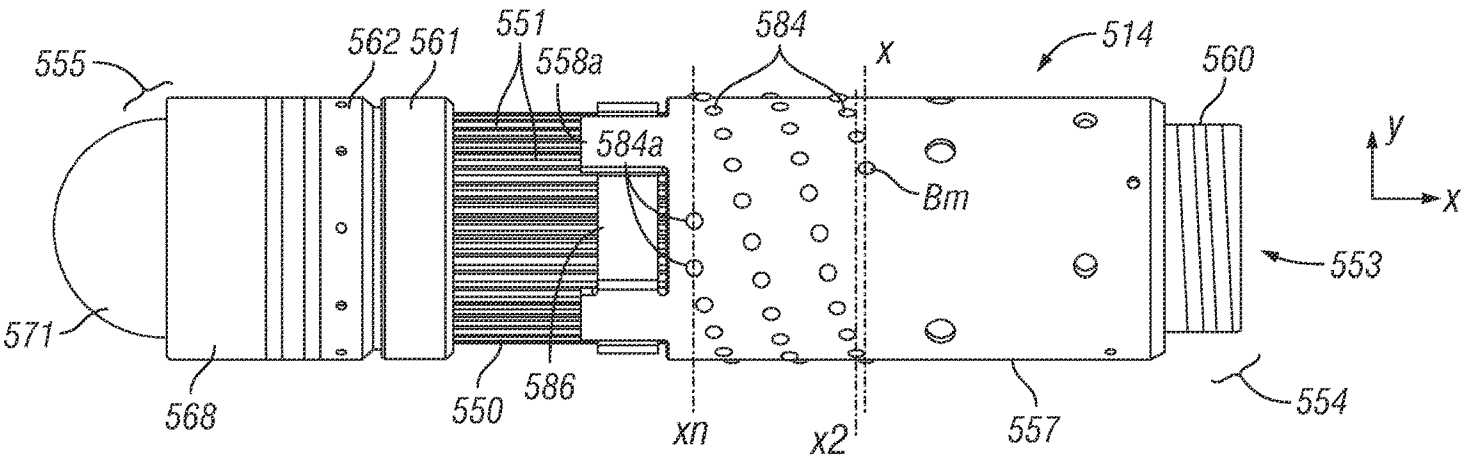
FIG. 5A shows a longitudinal side view of a plugging device according to embodiments of the disclosure.
Figure 5B:
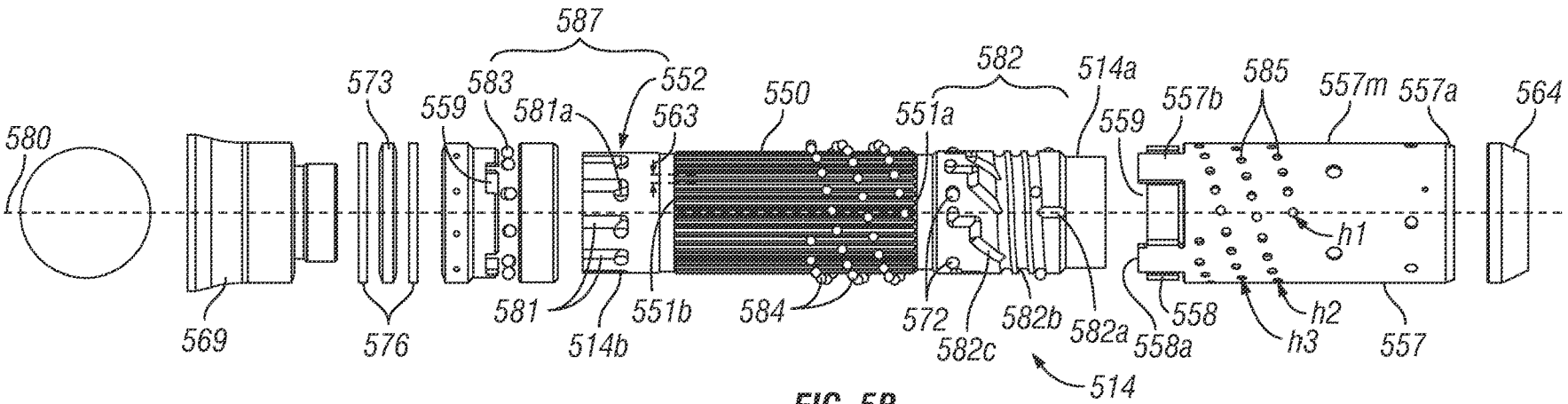
FIG. 5B shows a longitudinal side component breakout view of a plugging device like that of FIG. 5A according to embodiments of the disclosure.
Figure 5C:
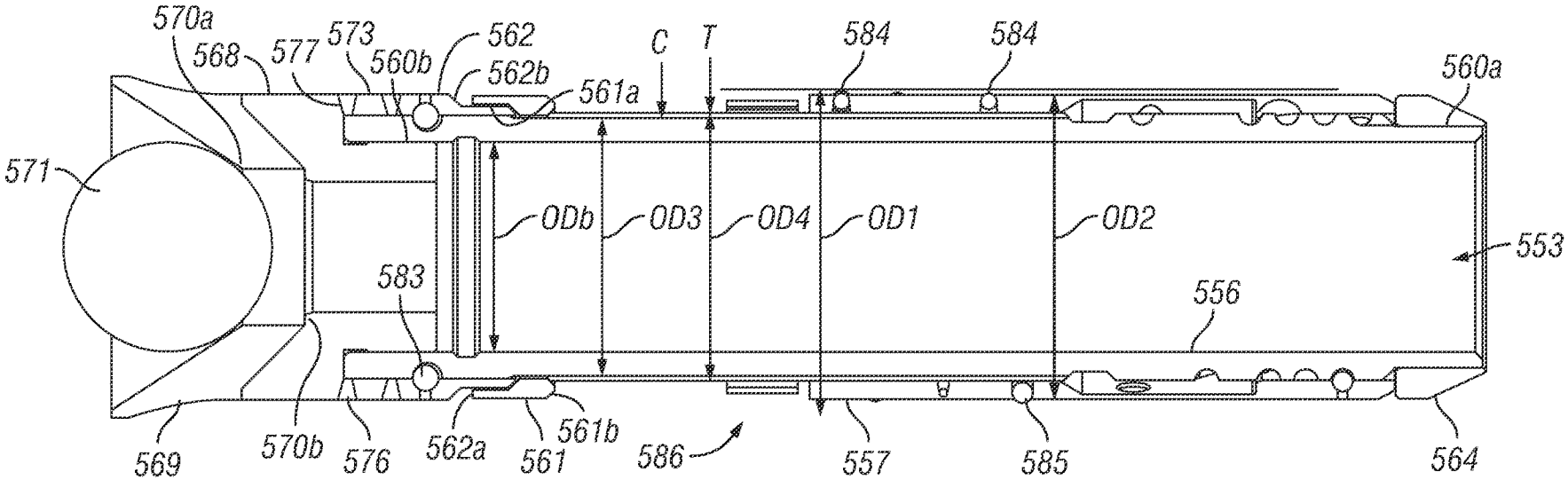
FIG. 5C shows a longitudinal side cross-sectional view of a plugging device like that of FIG. 5A according to embodiments of the disclosure.

Referring now to FIGS. 5A, 5B, and 5C, a longitudinal side view of a plugging device, a longitudinal side component breakout view of a plugging device, and a longitudinal side cross-sectional view a plugging device, respectively, in accordance with embodiments disclosed herein, are shown.

As would be apparent while the valves described herein may be stationary as part of a tubular (204), a plugging device 514 may be disposed within the tubular and run downhole therethrough. A valve (e.g., 202, 302, 402*a*, etc.) of the present disclosure may have the plugging device 514 engaged therewith, and thus forming a valve-plugging device assembly.

The plugging device 514 may be run, positioned, and operated as described herein and in other embodiments (such as in system 200, and so forth), and as otherwise understood to one of skill in the art. The plugging device 514 may be comparable or identical in aspects, function, operation, components, etc. as that of other embodiments disclosed herein. Similarities may not be discussed for the sake of brevity.

FIGS. 5A-5C together show the plugging device 514 may have a main plug body or mandrel 550. Although not limited to any particular shape, the main plug body 550 may be a generally cylindrical shape with a plug bore 553. In some embodiments, there need not be a bore 553. An inner diameter (Db) of the bore 553 may be any size as desired, and may be suitable for the flow of fluids therethrough. The bore 553 may extend through the entire plug body 550 from a distal end 554 to a proximate end 555. Either or both of the ends 554, 555 may be configured with a mating feature, such as a thread profile 560. As such, there may be threaded connections 560*a* and/or 560*b*. Analogously, body ends 514 *a, b* may have mating features, such as threads 560.

Although a plug inner surface 556 may be generally smooth, an outer plug surface 552 may be configured with one or more undulations or track grooves 551 (or comparable, such as splines). The plurality of grooves 551 need not helically wind like a thread, but may instead be axial on a longitudinal (i.e., parallel to long axis 580), such that any individual track groove 551 may have its own respective beginning point 551*a* and ending point 551*b*. In this respect, the counting may be rotation (such as of longitudinal grooves 551), counting may be longitudinal (such as with circumferential or helical grooves 551), or combinations thereof.

Any of the track grooves 551 of the plugging device 514 may be contemplated to have a respective crest C adjacent a trough T. The predominant portion of grooves 551 may have the crest C with outer diameter (D4) and trough T with outer diameter (D3); however, not all of the structure or grooves on the outer plug surface 552 are the same or uniform, with particular differences described herein.

For example, the outer surface 552 may have one or more J-slot grooves 581. There may also be a set of slot grooves 582. The slot grooves 582 may have one or more subportions 582 *a, b, c*, respectively. Apparent of the set of slot grooves 582 is that the portions 582 *a, b, c* may have different shapes and configurations, depending on what action might be needed related to the shiftable sleeve 557. This unique configuration allows the shiftable sleeve 557 to shift or move (such as incrementally) along the body 550 not only longitudinally, but also circumferentially (or radially), as the device 514 runs downhole. Generally cylindrical in nature, the shiftable sleeve 557 may be configured to generally accommodate whatever the shape of the body 550 may be.

The J-slot grooves 581 may be part of a load bearing section 587 associated with the upper body end 514*b*. That is, as the sleeve 557 increments along the outer surface 552, the sleeve 557 may eventually come into contact with a load ring 561 and/or a bearing plate 562. As these components continue to incrementally compress via the shifting (counting) of the sleeve 557, there may be inadvertent loading onto the seal element 573. As such, the j-slot ball 583 may instead bear the load while the ball 583 is in the "j-hook" section 581*a* of the groove 581. Once the predetermined number of counts occur, the ball(s) 583 may clear the section 581*a*, and now allows the seal element 573 to be loaded (expanded).

The shiftable sleeve 557 may be annular in nature with a distal sleeve end 557*a* and a proximate sleeve end 557*b*. The proximate sleeve end 557*b* may have a lower band 558, which may have one or more inner sleeve tabs or fingers 586. The inner sleeve tabs 586 may be configured to track along any of the track grooves 551. The tabs 586 may provide resistance against moving into a respective adjacent track groove 551 unless and until desired. The tab 586 may be biased (e.g., radially) inward. So even though the shiftable sleeve 557 may be movingly engaged with the body 550, there may be some amount of resistance that mitigates against completely free movement, especially circumferentially. This may be from, for example, a coefficient of friction between the surfaces of the track grooves 551, the tab(s) 586, and one or more (movable) sleeve members 584.

Figure 5D:
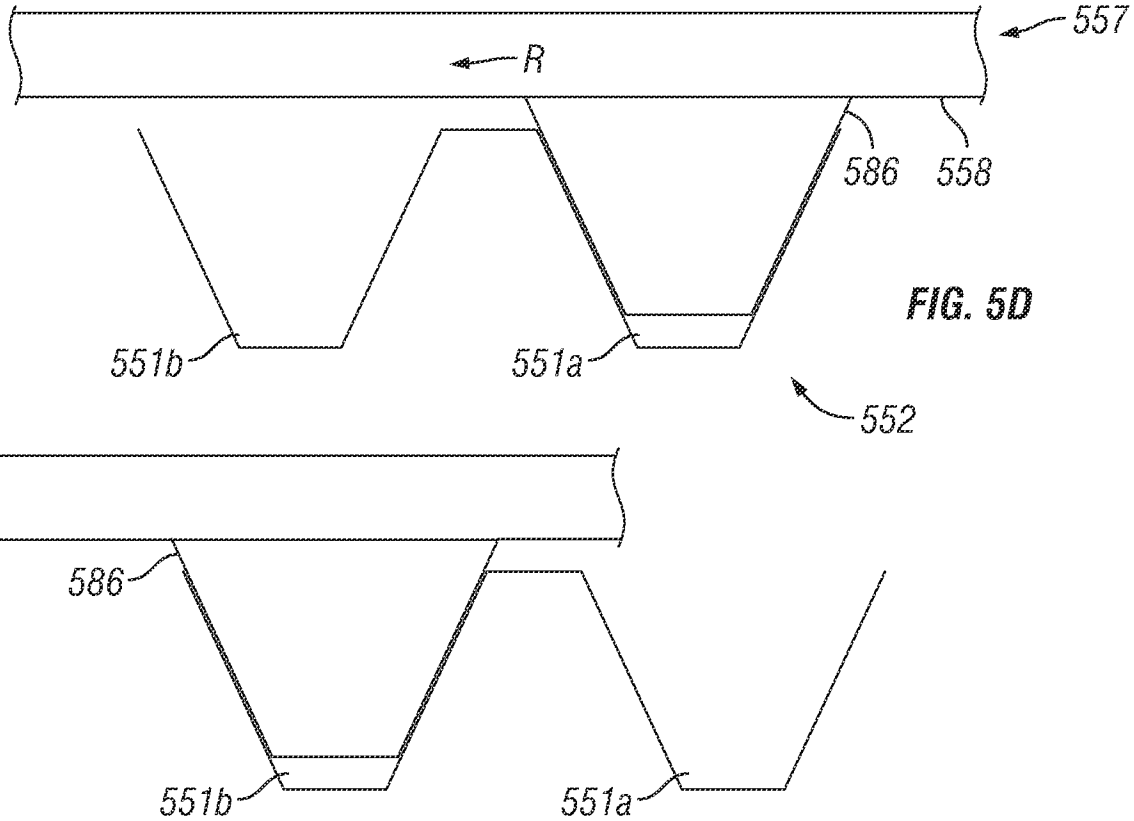
FIG. 5D shows a simplified lateral side cross-sectional view of a shiftable sleeve engaged with a grooved outer surface of a plugging device like that of FIG. 5A according to embodiments of the disclosure.
Figure 5E:
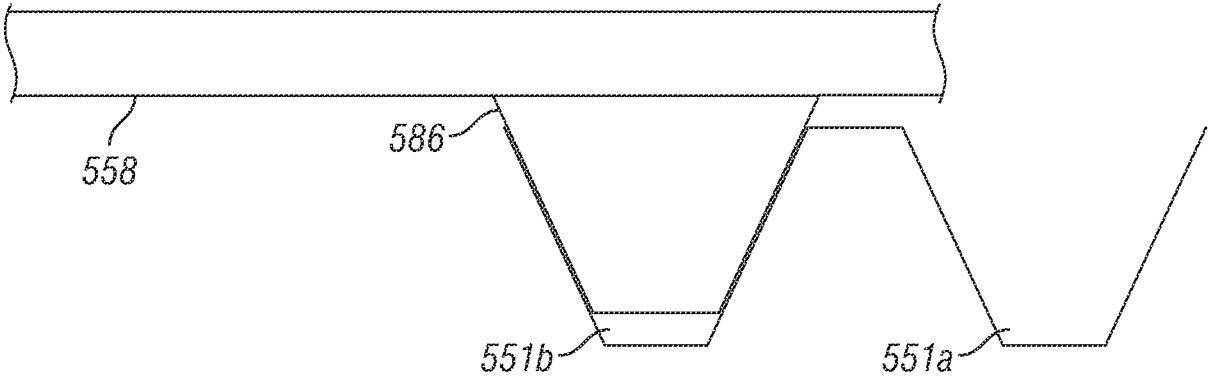
FIG. 5E shows a simplified lateral side cross-sectional view of the shiftable sleeve of FIG. 5D incremented circumferentially from a first groove to an adjacent groove according to embodiments of the disclosure.

Referring briefly to FIGS. 5D and 5E together, a simplified lateral side cross-sectional view of a shiftable sleeve engaged with a grooved outer surface of a plugging device and a simplified lateral side cross-sectional view of the shiftable sleeve incremented circumferentially from a first groove to an adjacent groove, respectively, in accordance with embodiments disclosed herein, are shown.

FIGS. 5D and 5E together illustrate a simplified example where the band 558 of the shiftable sleeve 557 has a tab or extension 586 tracking in a groove 551 (or a first groove 551*a* of a plurality of grooves 551). As the sleeve 557 shifts or counts, resulting in (circumferential) rotation R, the tab 586 may be compelled or forced to move into an adjacent or second groove 551*b*. The sequence may be repeated as many times may be needed to eventually arm and land the plugging device 514.

Returning to FIGS. 5A-5C together, as shown the plugging device 514 may have a one or more movable sleeve members 584. Although not limited to any particular shape, the members may be spherical or ball shape, and thus may interchangeably be referred to as a 'ball' herein for the sake of convenience. Other shapes, such as non-spherical or asymmetrical are possible, for example, capsule-shaped. The movable members 584 may be disposed in respective sleeve member receptacles 585. The sleeve member receptacles 585 may be configured and otherwise sized to hold sleeve members 584 resistively therein, yet offer enough space for freedom of the movement of the member(s) 584 as it passes over any given crest C or into a trough T.

The arrangement of the movable sleeve members 584 (and thus receptacles 585) may be as desired. As shown here, there may be a plurality of helicals h1, h2, h3, etc. In embodiments, there may be three helicals h1, h2, h3. In looking at any helical h1, h2, h3 in isolation, it is notable that each receptable 585 may be (radially) offset from a directly adjacent receptable of any respective helical. For example, one receptacle may have an x1, y1 coordinate, while the adjacent receptacle of the same helical has an x2, y2 coordinate (where x1 is unequal to x2, and y1 is unequal to y2).

However, a last series of members 584*a* (and corresponding sleeve receptacles) may lie proximate to each other in the same xn coordinate. The members 584*a* may be moved at the same time while interacting with the grooves (or splines) 551 in a manner that prevents over-rotating. That is one of the members 584*a* interacts in a first direction (or vector), while the other member 584*a* interacts oppositely, and thus counteracting each other. These members 584*a* may be the last moved members of any respective count as the plugging device goes through a valve.

On the other hand, in sequence of each helical, there may be overlap. For example, a ball midpoint Bm (i.e., a midpoint of a respective ball diameter) of a first member 584 in helical h1 may lie in the same x plane as a respective ball midpoint Bm of ball of helical h2 (see FIG. 5A). This type of arrangement may facilitate equal distribution of forces as the device 514 passes through a valve (while engaging a valve shoulder or surface).

The movable sleeve members 584 may have a resting position profile within the receptacles 585 that results in a larger OD1 (see FIG. 5C, for example) then other portions of the plugging device 514, such as tool OD2. As the device 514 passes through a valve, the valve may have a shoulder or other surface that urges or moves the respective member (s) 584 inwardly, thereby allowing subsequent rows of members 584 to engage therewith.

The interaction between the tab 586, the members 584, and the grooves 551 facilitates controlled and incremental movement of the shiftable sleeve 557 with respect to the body 550. How the sleeve 557 indexes (counts) or moves along the surface 552 may be determined or otherwise dependent upon how the tabs 586, members 584, and grooves 551 interact therewith. As described herein, this may be the result of how the plugging device 514 interacts with the valves (202, 302*a*, etc.). This type of configuration may allow facilitate a high level of accuracy when it comes to counting, as the sleeve 557 is not movable via inadvertent bumping.

The number of track grooves 551 is not meant to be limited; however, the number of grooves 551 may be formed (machined, etc.) in a manner to coincide with a desired range of incremental radial spacing or movement 563. As such, when the tab 586 is incremented, the degree range of movement of the sleeve 557 in a desired range, such as between about 7 degrees to about 11 degrees. In aspects, the degree range 563 may be about 9 degrees, which would account for about 40 track grooves 551. Each groove degree movement 563 may correspond to number of valves in a cluster of valves and/or a number of 'counts'.

While not meant to be limited, embodiments herein pertain to how in operation the shiftable sleeve 557 may only move in one direction, such as from the distal end 554 toward the proximate end 555. For example, when the shiftable sleeve 557 comes into contact with a shoulder surface of a frac sleeve, the surface may be resilient enough to bump the tab 586 from one track groove 551 to the next adjacent groove. Thus, while moving in a single direction, the shiftable sleeve 557 may have different freedoms of movement in doing so (namely, longitudinally, but also circumferentially or radially). In embodiments, the plugging device 514 may be configured to count backwards, such as when pulled out of hole in the reverse direction.

As the tab 556 is incremented, this may correspond to adequate clearance for the plugging device 514 to resume passing through the sleeve until another increment is needed. All of the members 584 may be engaged, which may be a 'count', 'cycle', 'increment' 'index', etc. of the shiftable sleeve 557. The plugging device 514 may then resume passage all the way through the sleeve, and proceed to a next valve sleeve, where the count sequence may repeat, albeit with the sleeve 557 indexed a single count (groove).

The plugging device 514 may be configured to count any desired amount of frac sleeves (of respective valves) simply by extending the length of the device 514, without need to add more track grooves 551. In embodiments there may be a range of an at least one valve to at least 1,000 valves. The range may be about 10 valves to about 100 valves. It is worth noting that the plugging device 514 may be configured to count a first frac valve, but pass through a next or second valve without counting it (i.e., without indexing [moving] the sleeve 557).

The body distal end 514*a* may have a lower sleeve 564 engaged therewith. The engagement with the body distal end 514*a* may be threadingly, such as via threaded connection 560*a*. The lower sleeve 564 may also have a lower cup or support fin (not viewable here) engaged therewith. The engagement between the lower sleeve 564 and the lower support fin may be threadingly, bonded, glued, etc. In assembly of the plugging device 514, the lower support fin may first be coupled with the lower sleeve 564, and then the lower sleeve (with fin) may be engaged with the body 550. While the lower sleeve 564 may be made of a rigid material, such as metal, the support fin may be made of a pliable material, such as rubber. The lower sleeve 564 and support fin may help with alignment as the plugging device 514 moves through a frac valve.

The proximate body end 514*b* may have an upper sleeve 568 engaged therewith. The engagement with the proximate body end 514*b* may be threadingly, such as threaded connection 560*b*. Any mating connection herein may be external or internal, and thus different from what might be shown in the Figures. The upper sleeve 568 may also have an upper cup or support fin 569 engaged therewith. The engagement between the upper sleeve 568 and the upper support fin 569 may be threadingly, bonded, glued, press-fit, etc. In assembly of the plugging device 514, the upper support fin 569 may first be coupled with the upper sleeve 568, and then the upper sleeve (with fin 569) may be engaged with the body 550, such as threadingly (see mating connection 560*b*).

While the upper sleeve 568 may be made of a rigid material, such as metal, the support fin 569 may be made of a pliable material, such as rubber. The upper sleeve 568 and support fin 569 may help with alignment as the plugging device 514 moves through a valve (202, 202*a*).

The fin 569 or the upper sleeve 568 may have an upper seat. For example, the fin 569 may have a fin seat 570*a*. In addition, or the alternative, the upper sleeve 568 may have upper sleeve seat 570*b*. Such a seat 570 *a/b* may be configured for a removable plug, such as a ball, 571 to seat thereagainst. The presence of the plug or ball 571 provides the ability for fluid pressure to flow the plugging device 514 downhole toward clusters of valves. The ball 571 may be made of a dissolvable material, which, while not limited, may be metallic. When the ball 571 is seated, flow through the bore 553 may be obstructed; however, when the ball 571 unseats, fluid may flow through the bore 553.

During pressurization, the ball 571 may be urged against the seat 570 *a/b* and provide a fluid tight seal. However, fluid may have a tendency to flow around the outside of the plugging device 514. As such, the plugging device may be configured with a seal element 573. The seal element 573 may be disposed between a backup ring 576 on each side thereof. The seal element 573 and backup rings 576 may be compressed against and otherwise held in place by an opposite side upper sleeve shoulder 577. Sufficient pressurization may therefore help form a resilient barrier and sealing engagement between the plugging device 514 and the frac valve to which it may be engaged.

The seal element 573 and backup ring 576 may be disposed between the upper sleeve 568, and a bearing plate 562. The underside of the bearing plate 562 may be engaged with one or more J-slot members 583. The bearing plate 562 may have a profiled or angled surface 562*b* that results in narrowed portion 562*a*.

The bearing plate 562 may be engaged with an expandable load ring 561. The expandable load ring 561 may have an underside ring surface 561*a* engaged with the narrowed portion 562*a*. The position of the shiftable sleeve 557 may correspond to whether the plugging device 514 is in an armed position or not. Shown in FIG. 5C is an unarmed or first position (also run-in) of the device 514. When armed or being moved to armed, the shiftable sleeve 557 may be engaged with an outer ring surface 561*b*, and the load ring 561 may be expanded radially outward, and over profile 562*b*. In moving to the armed position, sleeve extensions or ribs 558*a* may move into respective bearing plate slots 559.

Referring now to FIGS. 6A-6I, a longitudinal side cross-sectional view of a plugging device passing through a flex valve configured in a closed position, a longitudinal side cross-sectional view of a plugging device engaging a frac valve configured in a closed position, a partial transparent view of the plugging device and frac valve, a longitudinal side cross-sectional view of a plugging device ready to engage a flex valve configured in a closed position, a longitudinal side cross-sectional view of a plugging device in an armed position ready to open a flex valve configured in a closed position, a longitudinal side cross-sectional view of the plugging device and flex valve a zoom in longitudinal side cross-sectional view of the plugging device having moved the flex valve, a zoom in longitudinal side cross-sectional view of the plugging device ready to engage with (and open) another frac valve after moving a flex valve to an open position, and a zoom in longitudinal side cross-sectional view of the plugging device engaged with the another frac valve, respectively, in accordance with embodiments disclosed herein, are shown.

FIGS. 6A-6I show together the interaction between a plugging device and a respective valve. The device and respective valve may be engaged together to form a valve-device assembly suitable for use in a wellbore. The valve may be of one or more clusters of valves for use in a multistage frac operation. Any cluster may be one or more flex valves in association with a single frac valve.

The Figures illustrate the respective valve and plugging device as an assembly. While the Figures may not show a surrounding formation, wellbore, surrounding tubular/tubestring, and so forth, general understanding may be obtained by reference back to FIGS. 2A and 2B. As such, for the sake of brevity, side views of the interaction of the valve and plugging device are shown, some with zoom-in. When the valve and plugging device are used in a downhole system, applied fluid pressure down the tubular (204) may cause a toe valve (216) to shift open, exposing ports in the toe valve through which fluid F may be pumped into the formation (210). This may allow for fluid flow through the tubular and one or more plugging devices 614 may be pumped downhole. Any displaced fluid from pumping may exit through the ports in the toe valve, and out to the formation.

Figure 6A:
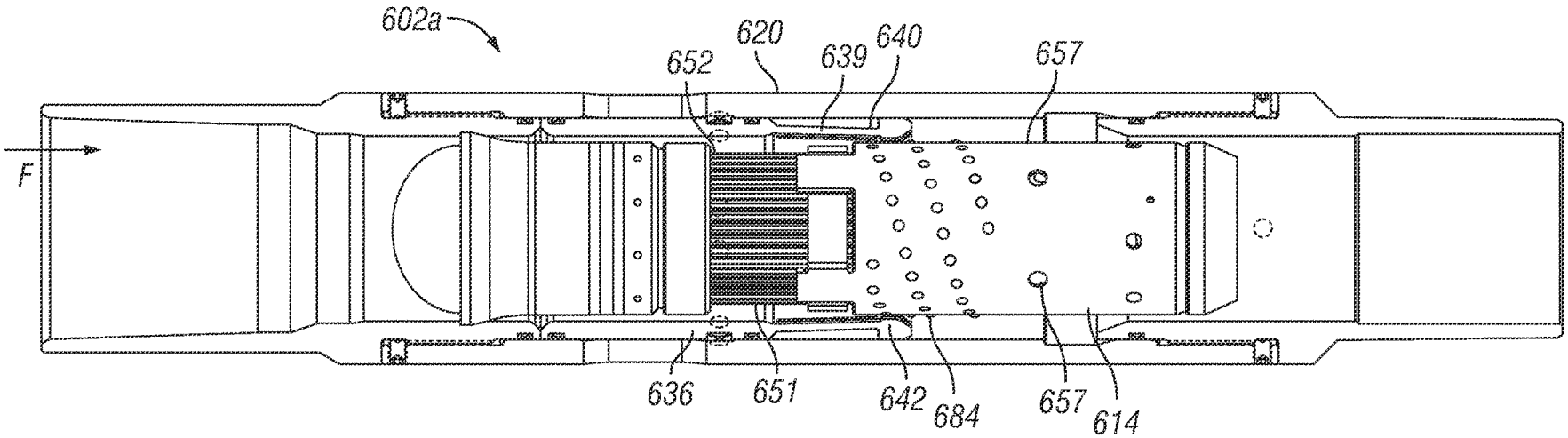
FIG. 6A shows a longitudinal side cross-sectional view of a plugging device passing through a flex valve configured in a closed position, according to embodiments of the disclosure.

As shown first in FIG. 6A, the plugging device 614 may be moved into engagement with a flex valve 602*a* (the flex valve 602*a* being readily discernable from the presence of a flex sleeve 636). Prior to passing into and through the flex valve 602*a*, the plugging device 614 may have passed through other flex valves (not shown here), as well as one or more frac valves (with a solid sleeve instead of a flex sleeve—not shown here). The effect of passing through the frac valve may be that an shiftable sleeve 657 may be moved along an outer surface 652 of the plugging device via interaction therewith. Each frac valve passed through may increment the index sleeve 657 one track groove 651.

However, the plugging device 614 may be precluded or otherwise configured from interacting with or otherwise opening a given flex valve 602*a*. As shown in FIG. 6A, when the flex sleeve 636 is closed (and may be held closed via one or more retainers) a lower or distal end 657*a* of the shiftable sleeve 657 may have enough clearance to move past ends 642 of collet fingers 640 (of collet 639) without causing the flex sleeve 636 to open. Regardless of the number of stages counted, at this point, the device 614 still may have an outer profile narrow enough to pass thereby (even if finger ends 642 contact the sleeve 657). The plugging device 614 may pass freely through any flex valve 602*a* until the shiftable sleeve 657 is incremented just enough that lower slot balls (572) become prone out of lower slot ball holes 667, at which point there is no more clearance and arming may commence (see, e.g., FIG. 6D).

Figure 6B:
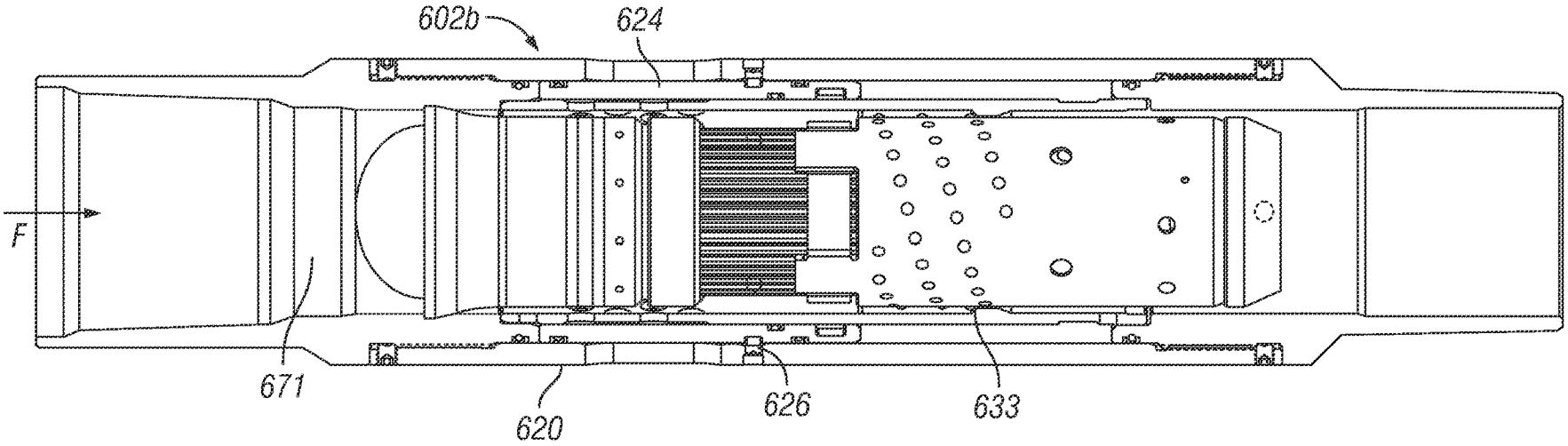
FIG. 6B shows a longitudinal side cross-sectional view of a plugging device engaging a frac valve configured in a closed position according to embodiments of the disclosure.
Figure 6C:
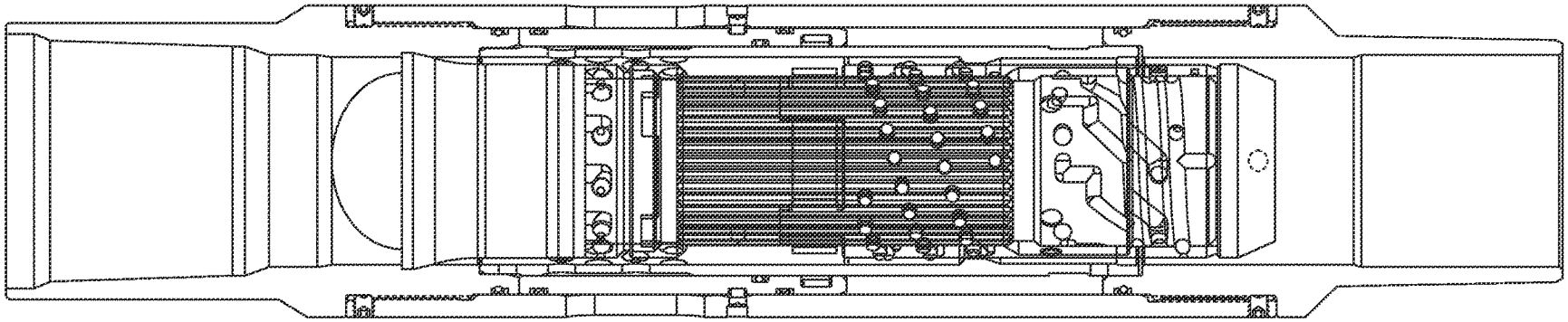
FIG. 6C shows a partial transparent view of the plugging device and frac valve of FIG. 6B according to embodiments of the disclosure.

FIGS. 6B and 6C together illustrate the plugging device 614 may be moved into engagement with a frac valve 602. Engagement of the two components may result in a valve-device assembly. The frac valve 602 may have a main body 620 engaged with a solid frac sleeve 624. The sleeve 624 may be sealingly and movingly engaged with the body 620, albeit initially retained in a first (or closed) position shown, as shown here, via one or more retainer members 626.

Readily apparent is that as profile of any movable member 684 comes into contact with an inner sleeve shoulder 633, this may result in engagement of the lower collet end 642 with the member(s) 684 as it moves thereagainst. Force (such as via pressurization fluid F) against the plugging device 614 (via its plug or ball 671) may urge these surfaces together until all of the members 684 are able to pass thereby. This contact results in incremental rotation of the shiftable sleeve 657 relative to the device body 650. This is comparable to a single stage count. The radial rotation of a single index count may be 8 degrees to about 10 degrees. In particular embodiments, the rotation is about 9 degrees.

Figure 6D:
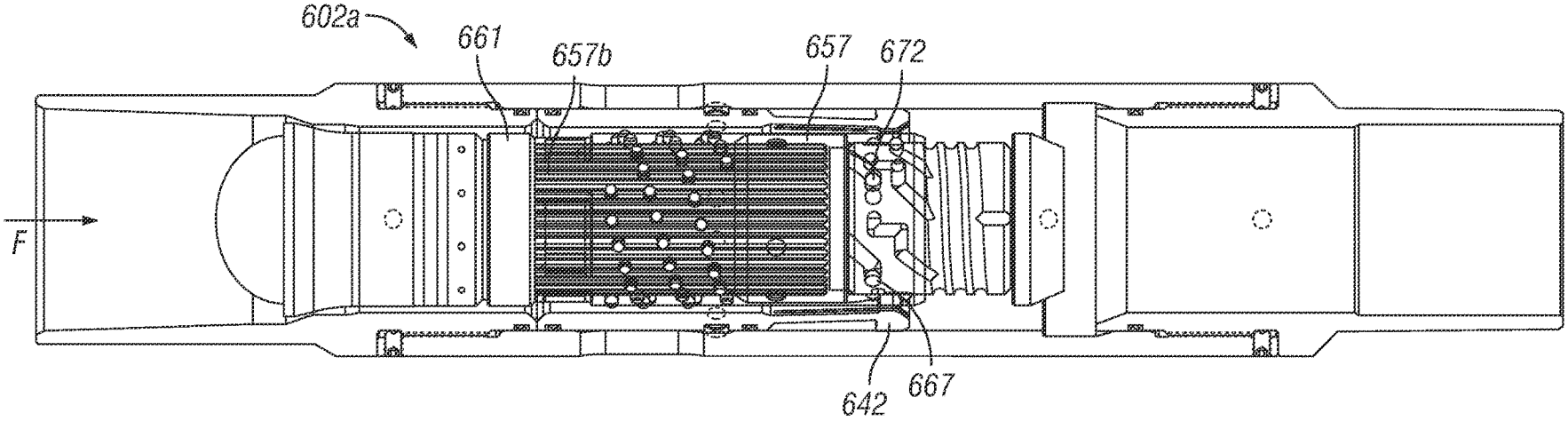
FIG. 6D shows a longitudinal side cross-sectional view of a plugging device ready to engage a flex valve configured in a closed position according to embodiments of the disclosure.

The cycle of counting through subsequent frac sleeves 602 is repeatable for any number of counts as may be desired. Distinguished by FIG. 6D is that the shiftable sleeve 657 may have cycled enough (such as through enough frac valves 602) so that in the very next stage of flex valves 602*a* the lower slot balls 672 may extend or be proud out of lower slot holes 667. As such, the lower slot balls 672 may now come into contact with finger ends 642. This may subsequently result in the proximate sleeve end 657*b* urged into contact with an expandable load ring 661.

Figure 6E:
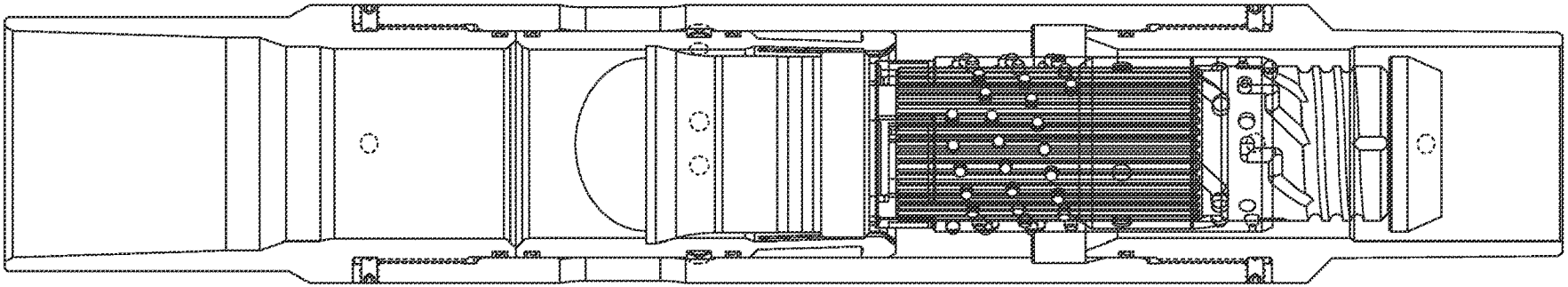
FIG. 6E shows a longitudinal side cross-sectional view of a plugging device in an armed position ready to open a flex valve configured in a closed position according to embodiments of the disclosure.
Figure 6F:
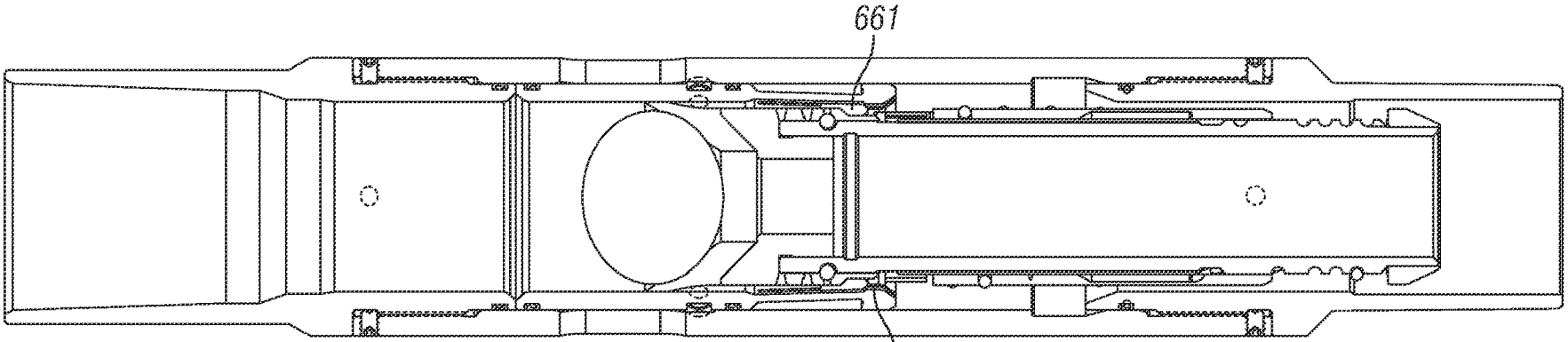
FIG. 6F shows a longitudinal side cross-sectional view of the plugging device and flex valve of FIG. 6E according to embodiments of the disclosure.

In aspects, the lower slot balls may be are pulled out of their pockets and extend out, proud enough to contact the flex sleeve 602*a* to open. The slot balls may contact the flex sleeve collet fingers, which results in the expandable load ring 661 drive out and around the bearing plate 662, as shown in FIGS. 6E-6F. Once the bearing plate 662 is proud, the lower slot balls may fall down into a groove, which then allows the device 614 to move further so that the expandable ring 661 may make contact with the fingers 642.

Figure 6G:
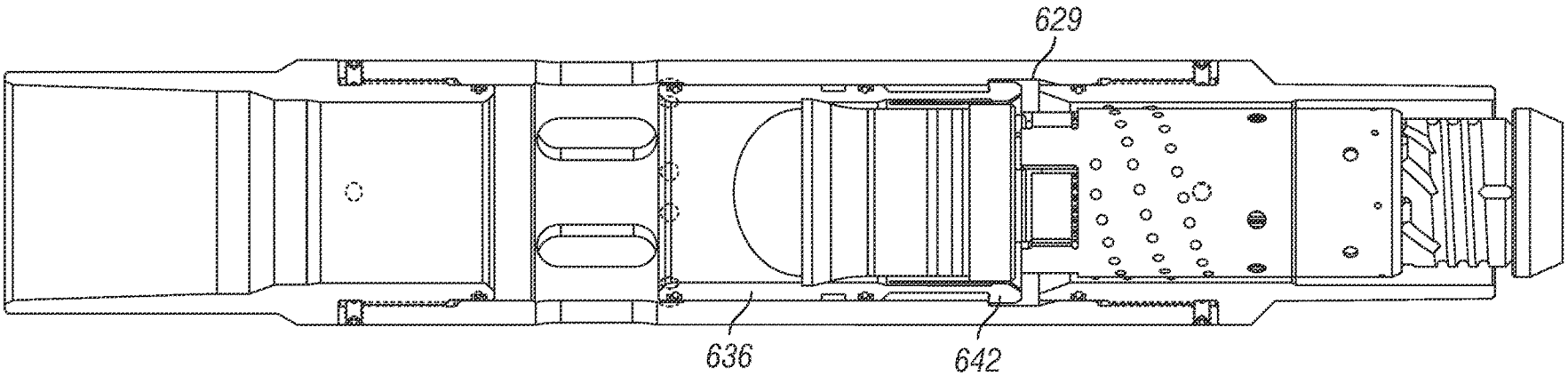
FIG. 6G shows a longitudinal side cross-sectional view of the plugging device having moved the flex valve of FIGS. 6E-6F to an open position according to embodiments of the disclosure.

This may be understood as an armed position. Or put another way, the device 614 may now have a radial profile of sufficient size that results in engagement in a manner suitable to open a flex valve 602*a* or a frac valve 602. The device 614 may move the flex sleeve 636 to an open position, which results in the fingers 642 being moved into receptacle 629, as shown in FIG. 6G. Once the fingers flex into the receptacle 629, sufficient fluid force F may urge the device out of the flex valve 602*a* and repeat the action for any subsequent flex valve thereafter.

Figure 6H:
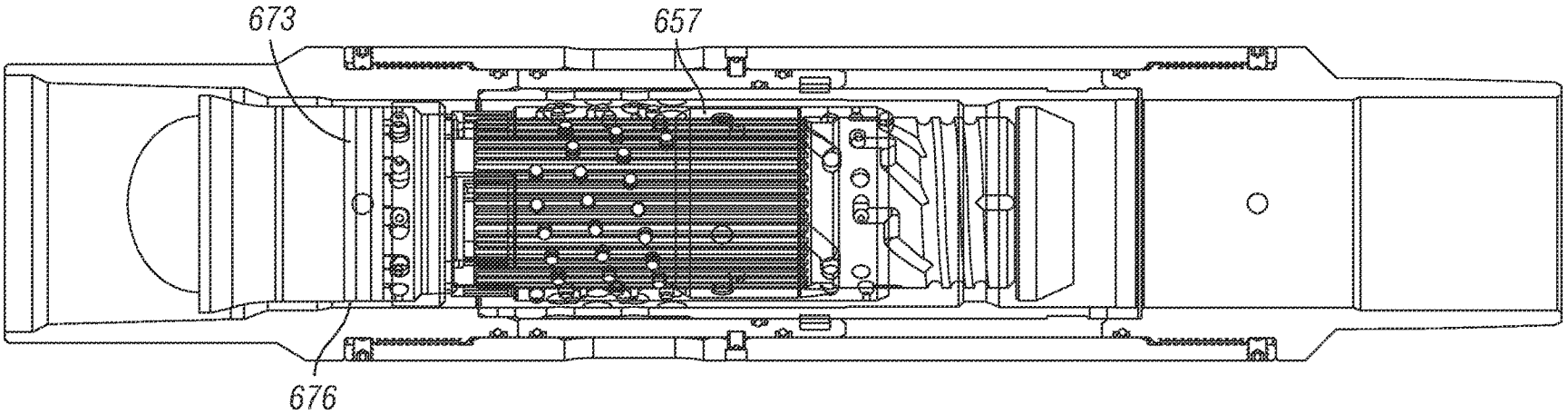
FIG. 6H shows a longitudinal side cross-sectional view of the plugging device ready to engage with (and open) another frac valve after moving a flex valve to an open position according to embodiments of the disclosure.
Figure 6I:
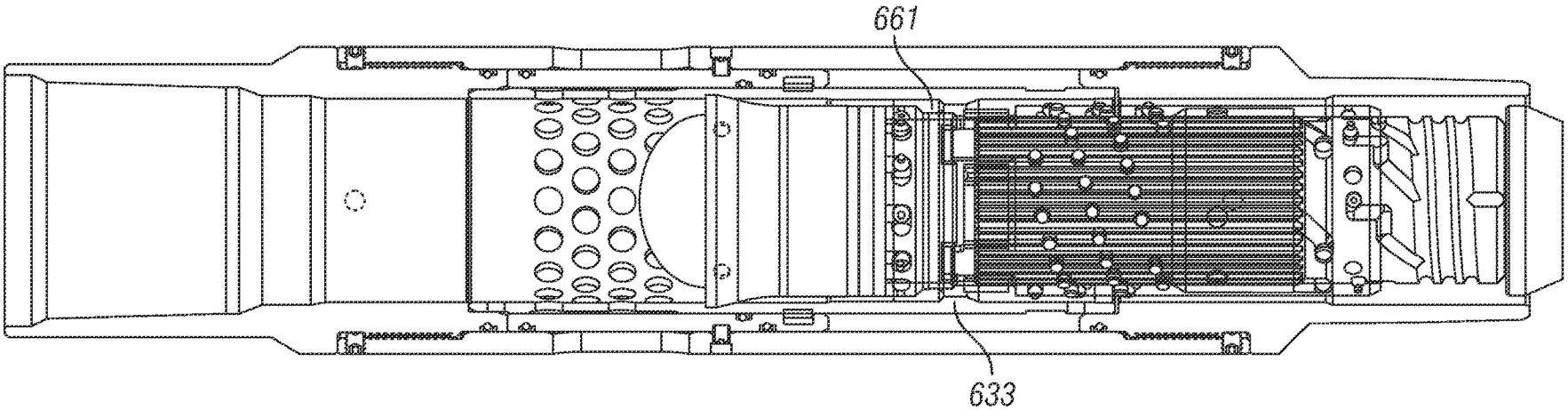
FIG. 6I shows a longitudinal side cross-sectional view of the plugging device engaged with the another frac valve of FIG. 6H according to embodiments of the disclosure.

FIGS. 6H and 6I show a final sequence whereby the device 614 may land in the final targeted frac sleeve 602. At this point, the shiftable sleeve 657 may rotate for its final increment, at which point j-slot balls 683 may move out of their respective j-slot 681, and thus allow the seal 673 (and/or any gauge ring 676) to be expanded or energized. In the landed position of FIG. 6I, the expandable load ring 661 may come into contact with the inner shoulder 633 of the frac sleeve.

Referring now to FIGS. 7A, 7B, 7C, and 7D, an isometric view, a longitudinal side cross-sectional view component breakout view, a longitudinal side view, respectively, of a plugging device, and a side view of different shape movable members, in accordance with embodiments disclosed herein, are shown.

As would be apparent while the valves described herein may be stationary as part of a tubular (204), a plugging device 714 may be disposed within the tubular and run downhole therethrough. A valve (e.g., 202, 302, 402*a*, etc.) of the present disclosure may have the plugging device 714 engaged therewith, and thus forming a valve-plugging device assembly.

The plugging device 714 may be run, positioned, and operated as described herein and in other embodiments (such as in system 200, and so forth), and as otherwise understood to one of skill in the art. The plugging device 714 may be comparable or identical in aspects, function, operation, components, etc. as that of other embodiments disclosed herein. Similarities may not be discussed for the sake of brevity.

Figure 7D:
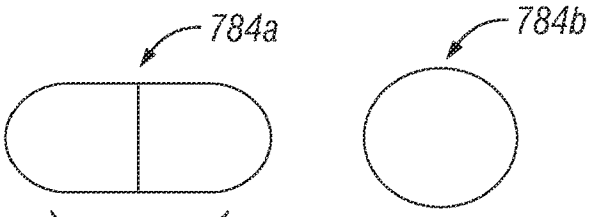
FIG. 7D shows a simplified side view of different shape movable members useable with a plugging device according to embodiments of the disclosure.
Figure 7A:
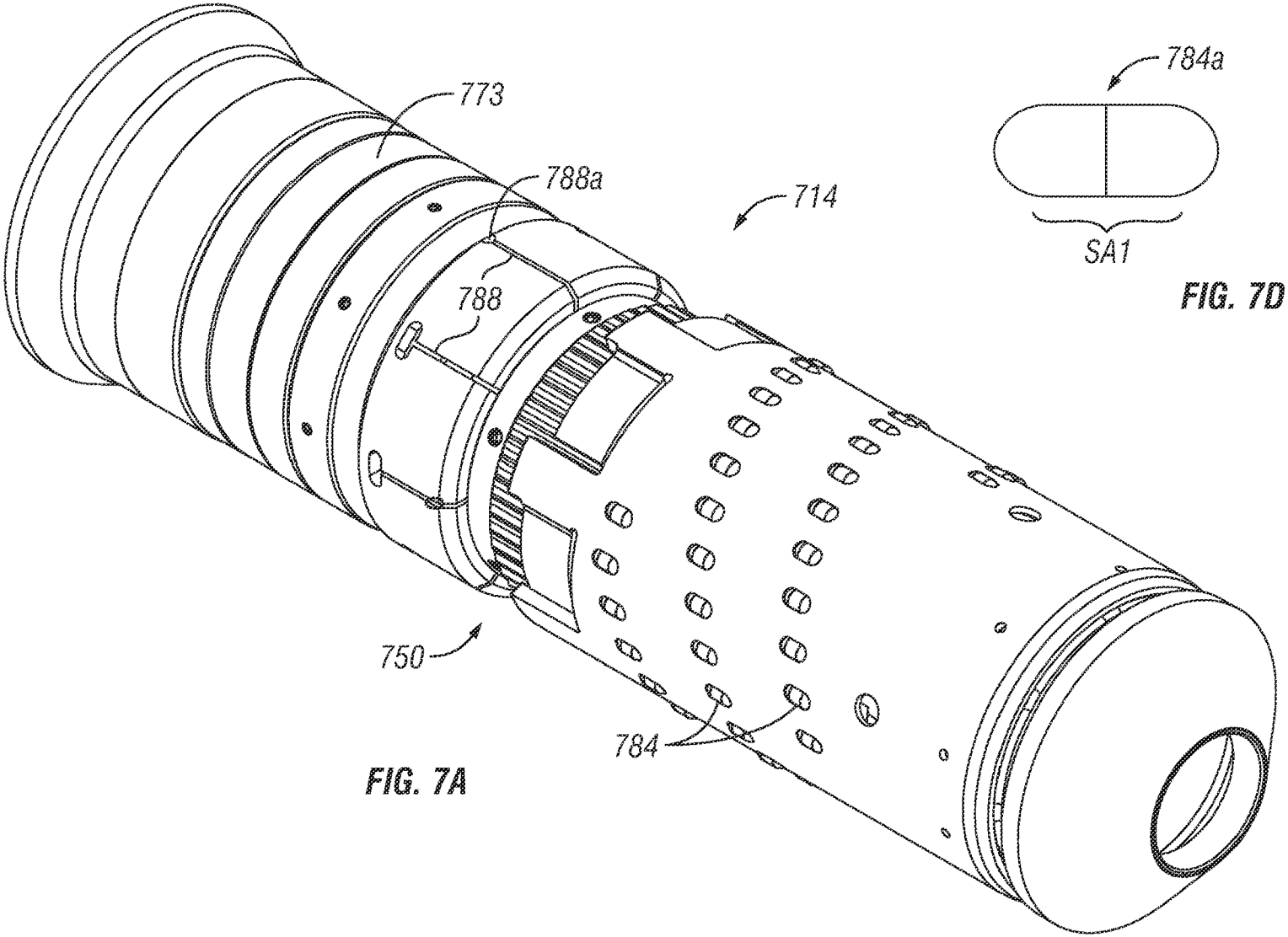
FIG. 7A shows an isometric view another plugging device according to embodiments of the disclosure.
Figure 7B:
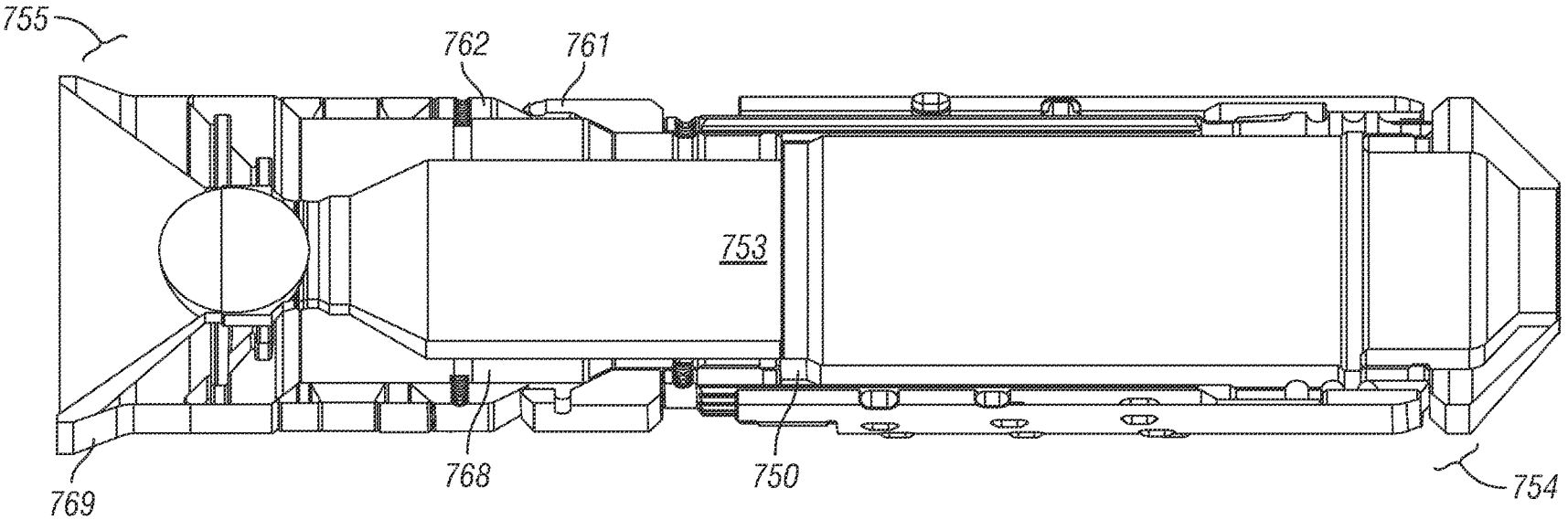
FIG. 7B shows a longitudinal side cross-sectional view of the plugging device of FIG. 7A according to embodiments of the disclosure.
Figure 7C:
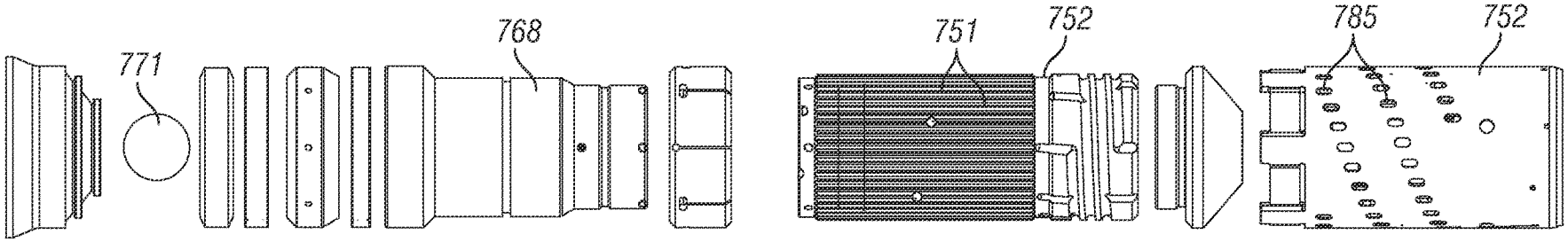
FIG. 7C shows a longitudinal side component breakout view of the plugging device of FIG. 7A according to embodiments of the disclosure.

FIGS. 7A-7C together show the plugging device 714 may have a main plug body 750. A bore 753 may extend through the entire plug body 750 from a distal end 754 to a proximate end 755. As the body 750 may be made up of one or more components, any component may have a respective bore coincidental to another respective bore.

An outer plug (or mandrel) surface 752 may be configured with one or more undulations or track grooves 751. One or more movable members 784 may be movingly disposed within respective receptacles 785 of a shiftable sleeve 757. The movable members 784 may be disposed within the receptacles 785 in a manner that facilitates movement (outward) as the member 784 engages with a respective crest (C) of any applicable groove 751.

The material of the plug body 750 may sometimes result in 'softer' grooves that may inadvertently be damaged as a result of forces incurred by the member 784 urged thereagainst. Thus, the shape of the moveable member 784 may be changed in order to facilitate easing these interactions. FIG. 7D shows by way of example a non-spherical member 784*a* and a spherical member 784*b*. The non-spherical member 784*a* may have a larger surface area SA1 for dissipating forces when contact is made with the applicable groove 751. A spherical member 784*b* may work with harder materials (such as steel), whereas a non-spherical member 784*a* may perform better with a softer, dissolvable material (such as magnesium).

With additional comparison to device 514, it would be apparent to one of skill in the art that device 714 need not have a load bearing section. That is, there may be instances where it may be okay to load a seal element 773 without having to delay. As such, an upper sleeve 768 may couple directly with the body 750. In this way, when the shiftable sleeve 757 increments sufficiently to engage a load ring 761, the load may be transferred to the bearing plate 762 without need of shifting a j-slot ball first. An upper fin 769 may be sufficient enough in strength and width (diameter) to open flex sleeves as the plugging device 714 moves through valve clusters.

The load ring 761 may have one or more (longitudinal) body grooves 788. One or more of the body grooves may be associated with an end point that facilitates a controlled or pre-determined breakpoint 788*a* of the ring 761. As one of skill would appreciate the more material is removed from a certain region or portion of a load ring, the more prone the area becomes to breaking or flexing first.

Other aspects associated with device 714 may be gleaned or understood by one of skill in the art in view of FIGS. 5A-5E and 6A-6I, and the accompanying description for operational and arming sequence.

One or more components of any device of embodiments disclosed herein may be made of reactive materials (e.g., materials suitable for and are known to dissolve, degrade, etc. in downhole environments [including extreme pressure, temperature, fluid properties, etc.] after a brief or limited period of time (predetermined or otherwise) as may be desired). In an embodiment, a component made of a reactive material may begin to react within about 3 to about 48 hours after exposure to a reaction-inducing stimulant. In some embodiments, the reactive material may begin to react, at least partially, upon coming into contact with any wellbore fluid (akin to instantaneously).

In embodiments, one or more components may be made of a metallic material, such as an aluminum-based or magnesium-based material. The metallic material may be reactive, such as dissolvable, which is to say under certain conditions the respective component(s) may begin to dissolve, and thus alleviating the need for drill thru. These conditions may be anticipated and thus predetermined. In embodiments, the components may be made of dissolvable aluminum-, magnesium-, or aluminum-magnesium-based (or alloy, complex, etc.) material, such as that provided by Nanjing Highsur Composite Materials Technology Co. LTD or Terves, Inc.

One or more components may be made of non-dissolvable materials (e.g., materials suitable for and are known to withstand downhole environments [including extreme pressure, temperature, fluid properties, etc.] for an extended period of time (predetermined or otherwise) as may be desired). Components may be 3D-printed or made with other forms of additive manufacturing.

Advantages.

Embodiments herein may advantageously solve the problem of pumping efficiency, cost, and water usage by allowing a user to hydraulic fracture more than one pin point location at a time. Systems and methods of the disclosure may reduce displacement water, perf erosion, and significant time on location. This may beneficially allow for reduced personal and services on site, and may thereby provide a simpler install and safer work environment for operators. This system also addresses all problems associated with legacy sleeves designs and plug and perf operations Other advantages pertain to use of an identical plugging device, which may reduce risk associated with machining and of installation, as well as reduce quality control risk. In a similar manner, the frac valve (with solid sleeve) and the frac valve (with flex sleeve) may also be manufactured identically, with similar benefits. Saving water, time on location, risk, personal on location, and service company costs (such as for wireline, pump down crew, and drillout) are a huge competitive advantage. When downhole operations run about $30,000-$40,000 per hour, a savings measured in minutes (albeit repeated in scale) is of significance. Again, even a small savings per stage results in an enormous savings on an annual basis.

Still other advantages may include (but not limited to): increased pump down and landing speeds/flow rates; allows for larger stage counts; more compact design that drastically reduces dart length at larger stage counts; reduced impact forces when counting allowing for use of softer materials and faster speeds; less sensitive to false counting when objects other than sleeves are encountered in the well; reliable stage counting by having two methods for ensuring only one count per sleeve is performed (eliminates inadvertently double counting one sleeve); allows for higher pressure capacity with softer materials.

The ability to 'count' or increment in a circumferential manner means the plugging device may be dramatically shorter than conventional devices. The shorter the device means, among other things, that material costs are reduced. The reduction in material costs may be especially appreciable when exotic dissolvable materials are desired.

While preferred embodiments of the disclosure have been shown and described, modifications thereof can be made by one skilled in the art without departing from the spirit and teachings of the disclosure. The embodiments described herein are exemplary only, and are not intended to be limiting. Many variations and modifications of the disclosure disclosed herein are possible and are within the scope of the disclosure. Where numerical ranges or limitations are expressly stated, such express ranges or limitations should be understood to include iterative ranges or limitations of like magnitude falling within the expressly stated ranges or limitations. The use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, and the like.

Accordingly, the scope of protection is not limited by the description set out above but is only limited by the claims which follow, that scope including all equivalents of the subject matter of the claims. Each and every claim is incorporated into the specification as an embodiment of the present disclosure. Thus, the claims are a further description and are an addition to the preferred embodiments of the present disclosure. The inclusion or discussion of a reference is not an admission that it is prior art to the present disclosure, especially any reference that may have a publication date after the priority date of this application. The disclosures of all patents, patent applications, and publications cited herein are hereby incorporated by reference, to the extent they provide background knowledge; or exemplary, procedural or other details supplementary to those set forth herein.

What is claimed is:

1. A downhole system for multistage fracturing a subterranean formation, the downhole system comprising:

a first cluster of valves;

a plugging device comprising:

a plug body having a distal end, a proximate end, and an outer surface;

a plurality of track grooves disposed on the outer surface;

a shiftable sleeve movingly disposed on the outer surface, the shiftable sleeve comprising a plurality of sleeve member receptacles, each with a respective movable member disposed therein;

wherein the shiftable sleeve is set in an initial position before entering the first cluster of valves, wherein each of the plurality of track grooves is arranged linear longitudinally along a long axis of the plugging device, wherein a midpoint of one of the plurality of track grooves is offset radially from a respective midpoint of a directly adjacent track groove, and wherein after leaving the first cluster of valves the shiftable sleeve is incremented from the distal end toward the proximate end, and at the same time a sleeve tab is incremented circumferentially from one groove of the plurality of track grooves to an adjacent track groove.

2. The downhole system of claim 1, the system further comprising:

a second cluster of valves downhole of the first cluster; and a third cluster of valves downhole from the second cluster, wherein the shiftable sleeve is moved to a first armed position by one of the second cluster of valves, and wherein the plugging device does not open any valves of the first and second cluster of valves, but opens every valve of the third cluster of valves.

3. The downhole system of claim 2, wherein each of the first cluster of valves, the second cluster of valves, and the third cluster of valves each comprise a flex valve comprising a flex sleeve configured with rigid portion and a flexible portion.

4. The downhole system of claim 3, wherein the flexible portion comprises a plurality of fingers.

5. The downhole system of claim 4, wherein the shiftable sleeve cannot engage the plurality of fingers unless it is in either the first armed position or a final armed position.

6. The downhole system of claim 5, wherein the plugging device further comprises a bearing plate having a bearing plate outer diameter and an expandable load ring having a load ring outer diameter, and wherein the final armed position comprises the expandable load ring having the load ring outer diameter larger than the bearing plate outer diameter.

7. The downhole system of claim 2, wherein each of the first cluster of valves, the second cluster of valves, and the third cluster of valves each comprise a frac valve comprising a solid sleeve configured with an inner sleeve shoulder.

8. The downhole system of claim 7, wherein the plugging device engages, but does not open, each of the frac valves of the first and second cluster of valves, and wherein the plugging device engages and opens the frac valve of the third cluster of valves.

9. The downhole system of claim 8, wherein the shiftable sleeve cannot open the frac valve of the third cluster of valves unless the shiftable sleeve is in a final armed position.

10. The downhole system of claim 9, wherein the plugging device further comprises a bearing plate having a bearing plate outer diameter and an expandable load ring having a load ring outer diameter, wherein the final armed position comprises the expandable load ring having the load ring outer diameter larger than the bearing plate outer diameter.

11. The downhole system of claim 1, wherein the proximate end of the body comprises a seal element, and at least one backup ring disposed therearound.

12. The downhole system of claim 1, wherein the number of the plurality of track grooves is in a track groove count range of at least 10 to no more than 100.

13. The downhole system of claim 12, wherein the proximate end of the body comprises a seal element, and at least one backup ring disposed therearound.

14. A downhole system for multistage fracturing a subterranean formation, the downhole system comprising:

a first cluster of valves;

a plugging device comprising:

a plug body having a distal end, a proximate end, and an outer surface;

a plurality of track grooves disposed on the outer surface;

a shiftable sleeve movingly disposed on the outer surface, the shiftable sleeve comprising a plurality of sleeve member receptacles, each with a respective movable member disposed therein;

wherein the shiftable sleeve is set in an initial position before entering the first cluster of valves, wherein each of the plurality of track grooves is arranged linear longitudinally along a long axis of the plugging device, wherein the plurality of sleeve member receptacles are disposed around the plug body in at least one of a first helical, a second helical, or both, and wherein after leaving the first cluster of valves, the shiftable sleeve is incremented circumferentially from the initial position.

15. The downhole system of claim 14, the system further comprising:

a second cluster of valves downhole of the first cluster; and a third cluster of valves downhole from the second cluster, wherein the shiftable sleeve is moved to a first armed position by one of the second cluster of valves, and wherein the plugging device does not open any valves of the first and second cluster of valves, but opens every valve of the third cluster of valves.

16. The downhole system of claim 15, wherein each of the first cluster of valves, the second cluster of valves, and the third cluster of valves each comprise a flex valve comprising a flex sleeve configured with rigid portion and a flexible portion.

17. The downhole system of claim 16, wherein the flexible portion comprises a plurality of fingers, wherein the shiftable sleeve cannot engage the plurality of fingers unless it is in the first armed position or a final armed position, wherein the plugging device further comprises a bearing plate having a bearing plate outer diameter and an expandable load ring having a load ring outer diameter, wherein the final armed position comprises the expandable load ring having the load ring outer diameter larger than the bearing plate outer diameter, and wherein the proximate end comprises a seal element and at least one backup ring disposed therearound.

18. The downhole system of claim 14, wherein the number of the plurality of track grooves is in a track groove count range of at least 10 to no more than 100.

19. The downhole system of claim 18, wherein the proximate end of the body comprises a seal element, and at least one backup ring disposed therearound.

20. A downhole system for multistage fracturing a subterranean formation, the downhole system comprising:

a first cluster of valves;

a plugging device comprising:

a plug body having a distal end, a proximate end, and an outer surface;

a plurality of track grooves disposed on the outer surface;

a shiftable sleeve movingly disposed on the outer surface, the shiftable sleeve comprising a plurality of sleeve member receptacles, each with a respective movable member disposed therein; and a longitudinal reference axis, wherein the shiftable sleeve is set in an initial position before entering the first cluster of valves, and wherein after leaving the first cluster of valves, the shiftable sleeve is incremented circumferentially from the initial position, wherein the plurality of sleeve member receptacles are disposed in a first helical and a second helical around the plug body, and wherein each of the plurality of track grooves is arranged in a linear orientation with respect to the longitudinal reference axis.

* * * * *